US009457352B2

(12) United States Patent
Koeda

(10) Patent No.: US 9,457,352 B2
(45) Date of Patent: Oct. 4, 2016

(54) THERMAL CYCLER

(75) Inventor: Hiroshi Koeda, Suwa (JP)

(73) Assignee: Seiko Epson Corporation (JP)

( * ) Notice: Subject to any disclaimer, the term of this patent is extended or adjusted under 35 U.S.C. 154(b) by 937 days.

(21) Appl. No.: 13/406,584

(22) Filed: Feb. 28, 2012

(65) Prior Publication Data

US 2012/0225001 A1 Sep. 6, 2012

(30) Foreign Application Priority Data

Mar. 1, 2011 (JP) ..... 2011-043598

(51) Int. Cl.
*B01L 9/06* (2006.01)
*B01L 7/00* (2006.01)
*B01L 3/00* (2006.01)

(52) U.S. Cl.
CPC ..... *B01L 7/525* (2013.01); *B01L 7/54* (2013.01); *B01L 9/06* (2013.01); *B01L 3/5082* (2013.01); *B01L 2200/0673* (2013.01); *B01L 2300/1811* (2013.01); *B01L 2300/1822* (2013.01); *B01L 2300/1827* (2013.01); *B01L 2300/1838* (2013.01); *B01L 2400/0457* (2013.01)

(58) Field of Classification Search
USPC ..... 435/303.1; 422/562
See application file for complete search history.

(56) References Cited

U.S. PATENT DOCUMENTS

2002/0155475 A1* 10/2002 Vischer ..... B01F 11/0002 435/6.11
2005/0153430 A1* 7/2005 Ohtaka ..... 435/287.2
2006/0083667 A1 4/2006 Kohara et al.
2007/0039866 A1* 2/2007 Schroeder et al. ..... 210/265
2009/0148912 A1* 6/2009 Takagi ..... 435/91.2
2009/0197274 A1* 8/2009 Takagi ..... 435/6
2011/0183378 A1* 7/2011 Takagi et al. ..... 435/91.2
2012/0184025 A1* 7/2012 Kawata et al. ..... 435/287.2

FOREIGN PATENT DOCUMENTS

| | | | |
|---|---|---|---|
| EP | 1788095 | A1 | 5/2007 |
| EP | 2 465 608 | A2 | 6/2012 |
| JP | 2006-110523 | A | 4/2006 |
| JP | 2009-136250 | | 6/2009 |
| WO | WO-2005-016532 | A2 | 2/2005 |
| WO | WO-2008139415 | A1 | 11/2008 |
| WO | WO-2012-073484 | A1 | 6/2012 |

OTHER PUBLICATIONS

Extended European Search Report for Application No. EP 12 15 7455 dated Feb. 3, 2014 (8 pages).

* cited by examiner

*Primary Examiner* — Jill Warden
*Assistant Examiner* — Brittany Fisher
(74) *Attorney, Agent, or Firm* — Harness, Dickey & Pierce, P.L.C.

(57) ABSTRACT

A thermal cycler includes a holder receiving a reaction chamber including a channel filled with reaction mixture and an immiscible liquid having different specific gravities and allowing the reaction mixture to move along an opposed inner wall, a temperature gradient forming unit forming a temperature gradient in the movement direction of the reaction mixture relative to the channel during loading into the holder, and a driving unit rotating the holder and temperature gradient forming unit about a rotation axis having a component perpendicular to the gravitational direction and a component perpendicular to the movement direction of the reaction mixture, and a maximum distance from the rotation axis to a point in the channel is smaller than a maximum distance connecting two points in the channel when projected on a plane perpendicular to the rotation axis.

5 Claims, 10 Drawing Sheets

| COMPOSITION | PRESERVATION CONCENTRATION | FINAL CONCENTRATION | DILUTION RATE | ADDITIVE AMOUNT(μL) |
|---|---|---|---|---|
| One Step SYBR RT-PCR Buffer | 2 x | 1 x | 2 | 10 μL |
| TaKaRa Ex Taq HS Mix | | | 16.6 | 1.2 μL |
| PrimeScript PLUS RTase Mix | | | 50 | 0.4 μL |
| F PRIMER Albumin | 10 μM | 0.4 μM | 25 | 0.8 μL |
| R PRIMER Albumin | 10 μM | 0.4 μM | 25 | 0.8 μL |
| RNase Free $dH_20$ | | | | 4.8 μL |
| Total RNA | | | | 2 μL |
| Total | | | | 20 μL |

FIG.12

| NUMBER | BEFORE REACTION | AFTER REACTION | RATIO OF BRIGHTNESS CHANGE (%) |
|---|---|---|---|
| 1 | 7.1 | 32.2 | 354 |
| 2 | 7.2 | 32.3 | 349 |
| 3 | 7.7 | 34.0 | 342 |
| 4 | 7.2 | 31.4 | 336 |
| 5 | 7.1 | 34.3 | 383 |
| 6 | 7.3 | 34.2 | 368 |
| 7 | 7.3 | 32.1 | 340 |
| 8 | 7.3 | 35.6 | 388 |
| 9 | 7.6 | 36.2 | 376 |
| 10 | 7.7 | 34.1 | 343 |
| 11 | 7.2 | 32.5 | 351 |
| 12 | 7.6 | 35.2 | 363 |
| 13 | 7.5 | 35.0 | 367 |
| 14 | 7.5 | 36.8 | 391 |

FIG.13A

| NUMBER | BEFORE REACTION | AFTER REACTION | RATIO OF BRIGHTNESS CHANGE (%) |
|---|---|---|---|
| 1 | 405982 | 1704615 | 320 |
| 2 | 448594 | 1755216 | 291 |
| 3 | 390663 | 2333047 | 497 |

FIG.13B

THERMAL CYCLER

CROSS-REFERENCE

This application claims priority to Japanese Patent Application No. 2011-043598, filed Mar. 1, 2011, the entirety of which is hereby incorporated by reference.

BACKGROUND

1. Technical Field

The present invention relates to a thermal cycler.

2. Related Art

In recent years, as a result of genetic application technology development, medical treatment utilizing genes such as genetic diagnosis or genetic therapy are drawing attention and, in addition, many methods utilizing genes in determining breed varieties or breed improvement have been developed in agricultural and livestock industries. Technologies such as the PCR (Polymerase Chain Reaction) method are in widespread use utilizing genes. Nowadays, the PCR method is an absolutely imperative technology in the breakthrough of information on biological materials.

The PCR method is a method of amplifying a target nucleic acid by applying a thermal cycle to a solution (reaction mixture) containing a nucleic acid which is a target of amplification (target nucleic acid) and a reagent. The thermal cycle is a process to periodically apply two or more stages of temperatures to the reaction mixture. In the PCR method, a method of applying two or three stages of thermal cycles is generally used.

In the PCR method, chambers designed for chemical reactions within the body which are referred to as tubes or biological sample reaction chips (biotips) are generally used. However, in the method of the related art, there are problems in that a large amount of reagent and a complicated apparatus are required to realize a thermal cycle required for reaction, or it takes a long time to react. Therefore, a biotip or a reaction apparatus for performing PCR in a short time with a high degree of accuracy by using a small amount of reagent or sample has been desired.

In order to solve such a problem, JP-A-2009-136250 discloses a biological sample reaction apparatus configured to apply a thermal cycle by rotating a biological sample reaction chip filled with reaction mixture and liquid which is immiscible with the reaction mixture and having a specific gravity smaller than that of the reaction mixture about an axis of rotation in the horizontal direction, thereby moving the reaction mixture.

The biological sample reaction apparatus disclosed in JP-A-2009-136250 is configured to mount the biological sample reaction chip on an apparatus having a temperature distribution that is symmetrical with respect to the axis of rotation and rotate the same, a radius of rotation of at least twice the length of the biometric sample reaction chip is required, and hence a reduction in the size of the apparatus is limited.

SUMMARY

An advantage of some aspects of the invention is to provide a thermal cycler suitable for reduction in size.

(1) An aspect of the invention is directed to a thermal cycler including: a holder configured to load a reaction chamber including a channel filled with reaction mixture and liquid having different specific gravity from the reaction mixture and being immiscible with the reaction mixture and configured to allow the reaction mixture to move along an opposed inner wall; a temperature gradient forming unit configured to form a temperature gradient in the direction in which the reaction mixture moves with respect to the channel when the reaction chamber is loaded in the holder; and a driving unit configured to rotate the holder and the temperature gradient forming unit about an axis of rotation having a component perpendicular to the direction in which the gravitational force acts and a component perpendicular to the direction of movement of the reaction mixture in the channel when the reaction chamber is loaded in the holder, wherein a maximum distance from the axis of rotation to a point in the channel is smaller than a maximum distance connecting two points in the channel when being projected on a plane perpendicular to the axis of rotation.

In this configuration, since the axis of rotation has the component perpendicular to the direction in which the gravitational force acts, and having the component perpendicular to the direction of movement of the reaction mixture in the channel of the reaction chamber when the reaction chamber is loaded in the holder, the positions of a lowermost point and/or an uppermost point in the direction in which the gravitational force acts in the channel of the reaction chamber loaded in the holder changes by the rotation of the holder by the driving unit. Accordingly, the reaction mixture moves in the channel in which the temperature gradient is formed by the temperature gradient forming unit. Therefore, a thermal cycle may be caused in the reaction mixture. Also, in this configuration, when being projected on the plane perpendicular to the axis of rotation, the maximum distance from the axis of rotation to the point in the channel of the reaction chamber is smaller than the maximum distance connecting the two points in the channel of the reaction chamber, and hence the radius of rotation by the driving unit can be reduced. Therefore, the thermal cycler suitable for reduction in size is realized.

(2) The thermal cycler may be configured such that the driving unit is configured to rotate the holder and the temperature gradient forming unit between a first disposition and a second disposition different from the first disposition in a position of the lowermost point in the channel in the direction in which the gravitational force acts when the reaction chamber is loaded in the holder, and the holder and the temperature gradient forming unit are rotated in the opposite directions between a case of rotating from the first disposition to the second disposition and a case of rotating from the second disposition to the first disposition.

In this configuration, since the driving unit rotates the holder and the temperature gradient forming unit in the opposite directions between the case of rotating from the first disposition to the second disposition and the case of rotating from the second disposition to the first disposition, a specific mechanism for reducing a kink in the wiring of the apparatus caused by the rotation is not necessary. Therefore, the thermal cycler suitable for reduction in size is realized.

(3)The thermal cycler may be configured such that the holder includes a first holder and a second holder configured to load the reaction chambers respectively; and the direction of movement of the reaction mixture in the reaction chamber to be loaded in the first holder and the direction of movement of the reaction mixture in the reaction chamber to be loaded in the second holder are parallel to each other.

In this configuration, the direction of movement of the reaction mixture in the reaction chamber to be loaded in the first holder and the direction of movement of the reaction mixture in the reaction chamber loaded in the second holder are parallel to each other, when the holder is rotated by the driving unit, the reaction mixture in the reaction chamber loaded in the first holder and the reaction mixture in the reaction chamber loaded in the second holder move at the same timing. Therefore, the thermal cycle under the same temporal conditions can be caused in the reaction chamber loaded in the first holder and the reaction chamber loaded in the second holder at the same timing.

(4) The thermal cycler may be configured such that the first holder and the second holder are at different positions when being projected on the plane perpendicular to the axis of rotation.

In this configuration, when being projected on the plane perpendicular to the axis of rotation, the first holder and the second holder can be relatively arranged in a direction other than the depth direction as viewed from the direction of the axis of rotation because the first holder and the second holder are at different positions. Accordingly, the size of the apparatus in the depth direction as viewed from the axis of rotation can be reduced. Therefore, the thermal cycler suitable for reduction in size is realized.

(5) The thermal cycler may be configured such that the axis of rotation is positioned in an area interposed between the first holder and the second holder when being projected on the plane perpendicular to the axis of rotation.

In this configuration, since the axis of rotation is positioned in the area interposed between the first holder and the second holder when being projected on the plane perpendicular to the axis of rotation, the radius of rotation caused by the driving unit may be reduced even when the holder includes the first holder and the second holder. Therefore, the thermal cycler suitable for reduction in size is realized.

BRIEF DESCRIPTION OF THE DRAWINGS

The invention will be described with reference to the accompanying drawings, wherein like numbers reference like element.

FIG. 12 is a table showing compositions of a reaction mixture in the second example.

FIG. 13A is a table showing results of fluorescent measurement in the first example.

FIG. 13B is a table showing results of fluorescent measurement in the second example.

DESCRIPTION OF EXEMPLARY EMBODIMENTS

Figure 1A:
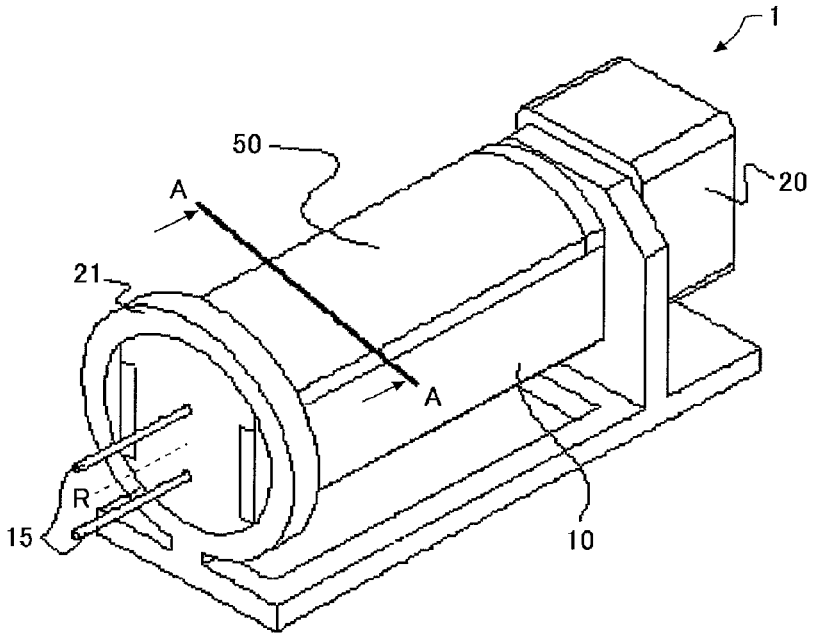
FIG. 1A is a perspective view showing a state in which a lid of a thermal cycler according to a first embodiment is closed.

Referring now to the drawings, preferred embodiments of the invention will be described in detail. The embodiments described below are not intended to limit the contents of the invention described in the appended Claims. All of the configurations described below are not necessarily requirements of the invention.

1. Entire Configuration of a Thermal Cycler According to a First Embodiment

Figure 1B:
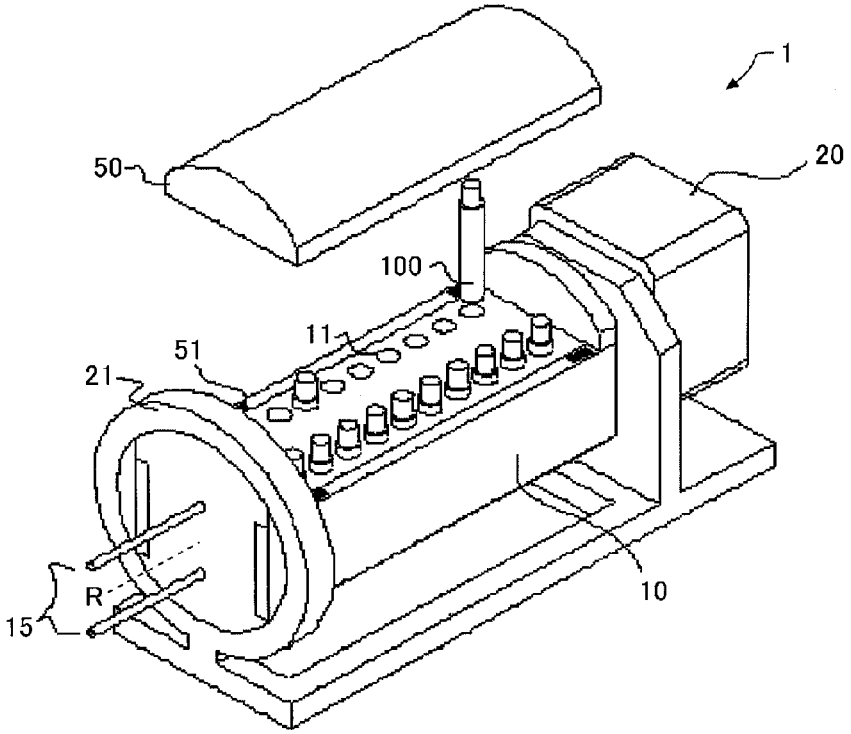
FIG. 1B is a perspective view showing a state in which the lid of the thermal cycler according to the first embodiment is opened.
Figure 2:
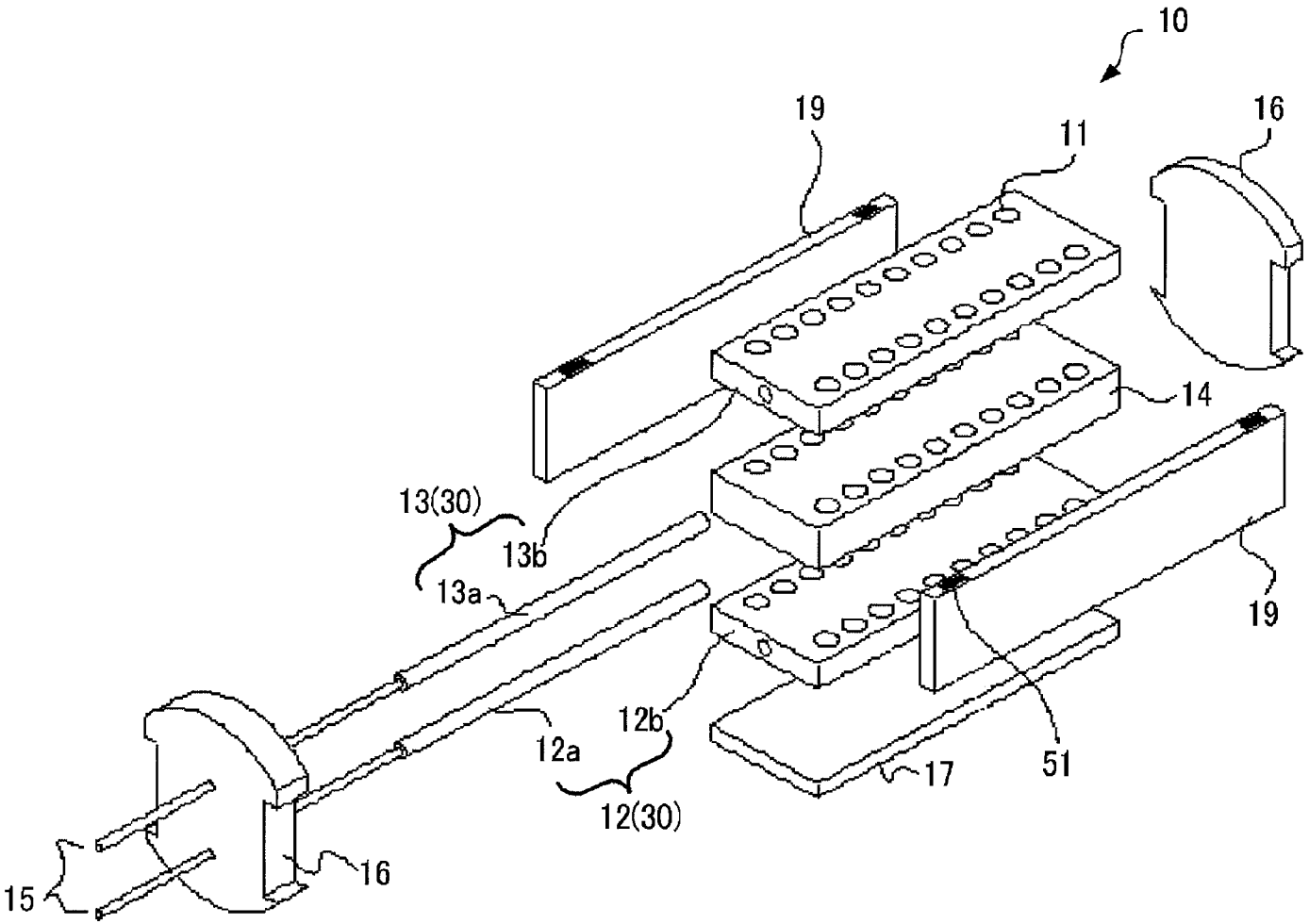
FIG. 2 is an exploded perspective view of a main unit of the thermal cycler according to the first embodiment.
Figure 3:
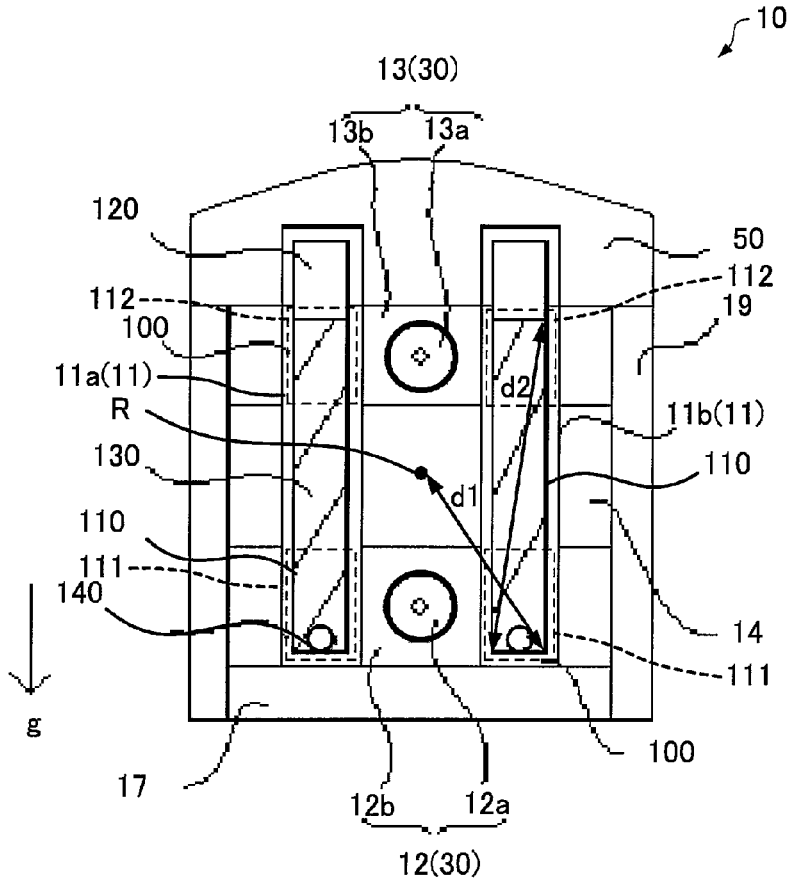
FIG. 3 is a cross-sectional view diagrammatically showing a section taken along a plane passing through a line A-A and perpendicular to an axis of rotation in FIG. 1A.

FIG. 1A is a perspective view showing a state in which a lid 50 of a thermal cycler 1 according to a first embodiment is closed, and FIG. 1B is a perspective view showing a state in which the lid 50 of the thermal cycler 1 according to the first embodiment is opened. FIG. 2 is an exploded perspective view of a main unit 10 of the thermal cycler 1 according to the first embodiment. FIG. 3 is a cross-sectional view diagrammatically showing a section taken along a plane passing through a line A-A and perpendicular to an axis of rotation R in FIG. 1A. In FIG. 3, an arrow g shows a direction in which the gravitational force acts.

The thermal cycler 1 according to the first embodiment includes holders 11 each configured to mount a reaction chamber 100 (described in detail later in section "3. Configuration of a reaction chamber to be loaded in a thermal cycler according to the first embodiment") filled with reaction mixture 140 and liquid 130 having a different specific gravity and being immiscible with the reaction mixture 140 therein and including a channel 110 in which the reaction mixture 140 moves along opposed inner walls, a temperature gradient forming unit 30 configured to form a temperature gradient in the direction of movement of the reaction mixture 140 with respect to the channel 110 (described in detail later in section "3. Configuration of a reaction chamber to be loaded in a thermal cycler according to the first embodiment") when the reaction chamber 100 is loaded in the holder 11, and a driving unit 20 configured to rotate the holders 11 and the temperature gradient forming unit 30 about the axis of rotation R having a horizontal component with respect to the direction in which the gravitational force acts and a perpendicular component with respect to the direction of movement of the reaction mixture 140 in the channel 110 when the reaction chamber 100 is loaded in the holder 11.

In the example shown in FIG. 1A, the thermal cycler 1 includes the main unit 10 and the driving unit 20. As shown in FIG. 2, the main unit 10 includes the holders 11 and the temperature gradient forming unit 30.

The holder 11 is configured to allow the reaction chamber 100 to be loaded therein. In the example shown in FIGS. 1B and 2, the holder 11 of the thermal cycler 1 has a slot structure which allows the reaction chamber 100 to be loaded therein by insertion. In the example shown in FIG. 2, the holder 11 has a structure to allow insertion of the reaction chamber 100 into a hole penetrating through a first heating block 12*b* of a first heating unit 12, a spacer 14 and a second heating block 13*b* of a second heating unit 13, described later. The number of holders 11 to be provided in the main unit 10 may be plural and, in the example shown in FIG. 1B, twenty holders 11 are provided in the main unit 10. In the example shown in FIG. 2 and FIG. 3, the holders 11 may be configured to be part of the temperature gradient forming unit 30, or the holders 11 and the temperature gradient forming unit 30 may be configured as separate members as long as the positional relationship between the holders 11 and the temperature gradient forming unit 30 does not change when the driving unit 20 is driven.

In this embodiment, although an example in which the holder 11 has a slot structure is shown, the holder 11 only has to have a structure which is capable of holding the reaction chamber 100. For example, a structure in which the reaction chamber 100 is fitted into a depression having a shape matching the shape of the reaction chamber 100, or a structure which holds the reaction chamber 100 by clamping the same may be employed.

The temperature gradient forming unit 30 forms the temperature gradient in the direction of movement of the reaction mixture 140 with respect to the channel 110 when the reaction chamber 100 is loaded in the holder 11. Here, the term "to form the temperature gradient" means to form a state in which the temperature changes along a predetermined direction. Therefore, the term "the temperature gradient is formed in the direction of movement of the reaction mixture 140" means to form a state in which the temperature changes along the direction of movement of the reaction mixture 140. The "state in which the temperature changes along a predetermined direction" may be a state in which the temperature is increased or decreased monotonously in the predetermined direction or the temperature change may be changed from increasing to decreasing, or from decreasing to increasing at a midpoint along the predetermined direction. In the example shown in FIG. 2, the temperature gradient forming unit 30 is configured to include the first heating unit 12 and the second heating unit 13. In the main unit 10 of the thermal cycler 1, the first heating unit 12 is disposed on the side relatively close to a bottom plate 17, and the second heating unit 13 is disposed on the side relatively far from the bottom plate 17. The spacer 14 is provided between the first heating unit 12 and the second heating unit 13. In the main unit 10 of the thermal cycler 1, the first heating unit 12, the second heating unit 13, and the spacer 14 are fixed at peripheries thereof with a flange 16, the bottom plate 17, and a locking plate 19. As long as the temperature gradient is formed to an extent that desired reaction accuracy is achieved, the number of heating units included in the temperature gradient forming unit 30 is arbitrary. For example, by configuring the temperature gradient forming unit 30 with a single heating unit, the number of members to be used may be reduced, so that the manufacturing cost may be reduced.

The first heating unit 12 heats a first portion 111 of the reaction chamber 100 to a first temperature when the reaction chamber 100 is loaded in the holder 11. In the example shown in FIG. 3, the first heating unit 12 is disposed at a position capable of heating the first portion 111 of the reaction chamber 100 in the main unit 10.

The first heating unit 12 may include a mechanism which generates heat and a member which conducts the generated heat to the reaction chamber 100. In the example shown in FIG. 2, the first heating unit 12 includes a first heater 12*a* as a mechanism which generates heat, and the first heating block 12*b* as a member which conducts the generated heat to the reaction chamber 100.

In the thermal cycler 1, the first heater 12*a* is a cartridge heater, and is connected to an external power source, not shown by a conductor wire 15. The first heater 12*a* is not limited to the one described above, and a carbon heater, a sheet heater, an IH heater (electromagnetic induction heater), Peltier device, heating liquid, heating gas, and the like may be employed. The first heater 12*a* is inserted into the first heating block 12*b*, and the first heating block 12*b* is heated by heat generation of the first heater 12*a*. The first heating block 12*b* is a member conducting the heat generated by the first heater 12*a* to the reaction chamber 100. In the thermal cycler 1, the first heating block 12*b* is an aluminum block. Since the temperature control of the cartridge heater is easy, the stabilization of the temperature of the first heating unit 12 can easily be achieved by employing the cartridge heater as the first heater 12*a*. Therefore, a more accurate thermal cycle is realized.

The material of the heating block may be selected as needed by considering conditions such as heat conductivity, heat retaining properties, or workability. For example, since aluminum has high heat conductivity, the reaction chamber 100 can be heated efficiently by employing aluminum as the material of the first heating block 12*b*. Also, since unevenness of heating can hardly occur in the heating block, a thermal cycle with high degree of accuracy is realized. Also, because of working ease, the first heating block 12*b* can be molded with high degree of accuracy and hence accuracy of heating may be enhanced. Therefore, a more accurate thermal cycle is realized. The material of the heating block may be copper alloy, for example, or a plurality of materials may be combined.

The first heating unit 12 preferably is in contact with the reaction chamber 100 when the reaction chamber 100 is loaded in the holder 11. Accordingly, when the reaction chamber 100 is heated by the first heating unit 12, the heat of the first heating unit 12 may be conducted stably to the reaction chamber 100, so that the temperature of the reaction chamber 100 can be stabilized. As in this embodiment, when the holder 11 is formed as a part of the first heating unit 12, the holder 11 is preferably brought into contact with the reaction chamber 100. Accordingly, the heat of the first heating unit 12 can be conducted stably to the reaction chamber 100, so that the reaction chamber 100 can be efficiently heated.

The second heating unit 13 heats a second portion 112 of the reaction chamber 100 to a second temperature different from the first temperature when the reaction chamber 100 is loaded in the holder 11. In an example shown in FIG. 3, the second heating unit 13 is disposed at a position capable of heating the second portion 112 of the reaction chamber 100 in the main unit 10. The second heating unit 13 includes a second heater 13*a* and the second heating block 13*b*. The configuration of the second heating unit 13 is the same as that of the first heating unit 12 except that an area of the reaction chamber 100 to be heated and the temperature to be heated are different from those of the first heating unit 12. Heating mechanisms different from the first heating unit 12 and the second heating unit 13 may be employed. The material of the first heating block 12*b* and the material of the second heating block 13*b* may be different.

A cooling unit configured to cool the second portion 112 may be provided instead of the second heating unit 13. As the cooling unit, for example, Peltier device may be used. Accordingly, even when the temperature of the second portion 112 can hardly be decreased due to heat from the first portion 111 of the reaction chamber 100, a desired temperature gradient can be formed in the channel 110. Also, for example, a thermal cycle which repeats heating and cooling may be applied to the reaction mixture 140.

As shown in FIGS. 2 and 3, when the holder 11 is formed as part of the temperature gradient forming unit 30, a mechanism which brings the holder 11 into tight contact with the reaction chamber 100 may be provided. The mechanism to bring the holder 11 into tight contact with the reaction chamber 100 may be achieved by bringing at least part of the reaction chamber 100 into tight contact with the holder 11. For example, the reaction chamber 100 may be pressed against one of wall surfaces of the holder 11 by a spring provided on the main unit 10 or on the lid 50. Accordingly, since the heat of the temperature gradient forming unit 30 may be conducted to the reaction chamber 100 further stably, the temperature of the reaction chamber 100 can be further stabilized.

The temperatures of the first heating unit 12 and the second heating unit 13 may be controlled by a temperature sensor, not shown, and a controller, described later. The temperatures of the first heating unit 12 and the second heating unit 13 are preferably set so that the reaction chamber 100 is heated to a desired temperature. In this embodiment, by controlling the first heating unit 12 to the first temperature, and the second heating unit 13 to the second temperature, the first portion 111 of the reaction chamber 100 can be heated to the first temperature and the second portion 112 can be heated to the second temperature. The temperatures of the first heating unit 12 and the second heating unit 13 only have to be controlled so that the first portion 111 and the second portion 112 of the reaction chamber 100 are heated to desired temperatures. For example, by considering the material and the size of the reaction chamber 100, the temperatures of the first portion 111 and the second portion 112 may be heated to the desired temperatures accurately. The temperature sensor in this embodiment is a thermocouple. The temperature sensor is not limited to the thermocouple, and may be a resistance thermometer or a thermister.

The driving unit 20 is a mechanism configured to rotate the holder 11 and the temperature gradient forming unit 30 about the axis of rotation R having a component perpendicular to the direction in which the gravitational force acts and a component perpendicular to the direction of movement of the reaction mixture 140 in the channel 110 when the reaction chamber 100 is loaded in the holder 11.

The direction "having a component perpendicular to the direction in which the gravitational force acts" is a direction having a perpendicular component with respect to the direction in which the gravitational force acts in a case of being expressed by a vector sum of a "component parallel to the direction in which the gravitational force acts" and the "component perpendicular to the direction in which the gravitational force acts".

The direction "having a component perpendicular to the direction of movement of the reaction mixture 140 in the channel 110" is a direction having a perpendicular component with respect to the direction of movement of the reaction mixture 140 in the channel 110 in a case of expressing by a vector sum of a "component parallel to the direction of movement of the reaction mixture 140 in the channel 110" and the "component perpendicular to the direction of movement of the reaction mixture 140 in the channel 110".

In the thermal cycler 1 according to the first embodiment, the driving unit 20 rotates the holder 11 and the temperature gradient forming unit 30 about the identical axis of rotation R. In this embodiment, the driving unit 20 includes a motor and a drive shaft, not shown, and is configured by connecting the drive shaft and the flange 16 of the main unit 10. When the motor of the driving unit 20 is activated, the main unit 10 is rotated about the drive shaft as the axis of rotation R. The positional relationship between the axis of rotation R and the holder 11 is described in section of "2. Positional Relationship between Axis of Rotation and Holder". The driving unit 20 is not limited to the motor, and may be, for example, a handle, a spiral spring, or the like.

The thermal cycler 1 may include a controller, not shown. The controller controls at least one of the driving unit 20 and the temperature gradient forming unit 30. An example of the control by the controller is described in section "4. Example of Thermal Cycle Procedure of Thermal Cycler". The controller may be implemented by a specific circuit, and may be configured to perform control described later. The controller may function as a computer to perform the control described later by executing a control program stored in a memory device such as a ROM (Read Only Memory) or a RAM (Random Access Memory) by a CPU (Central Processing Unit). In this case, the memory device may have a work area for storing intermediate data in association with the control and the result of control temporarily.

The main unit 10 of the thermal cycler 1 includes the spacer 14 provided between the first heating unit 12 and the second heating unit 13 as shown in FIG. 2 and FIG. 3. The spacer 14 is a member that holds the first heating unit 12 and/or the second heating unit 13. By the provision of the spacer 14, the distance between the first heating unit 12 and the second heating unit 13 may be determined more accurately. In other words, the positions of the first heating unit 12 and the second heating unit 13 with respect to the first portion 111 and the second portion 112 of the reaction chamber 100 may be determined more accurately.

The material of the spacer 14 may be selected as needed, but preferably is a heat-insulating member. Accordingly, the effects that heat from the first heating unit 12 and the second heating unit 13 have on each other may be reduced, and hence the temperature control of the first heating unit 12 and the second heating unit 13 may be facilitated. When the spacer 14 is the heat-insulating member, when the reaction chamber 100 is loaded in the holder 11, the spacer 14 is preferably disposed so as to surround the reaction chamber 100 in an area between the first heating unit 12 and the second heating unit 13. Accordingly, since heat radiation from the area between the first heating unit 12 and the second heating unit 13 of the reaction chamber 100 can be inhibited, the temperature of the reaction chamber 100 is further stabilized. In this embodiment, the spacer 14 is the heat-insulating member, and in the example shown in FIG. 3, the holder 11 is configured to penetrate through the spacer 14. Accordingly, when the reaction chamber 100 is heated by the first heating unit 12 and the second heating unit 13, the heat loss of the reaction chamber 100 can hardly be occurred, so that the temperatures of the first portion 111 and the second portion 112 may further be stabilized.

The main unit 10 of the thermal cycler 1 may include the locking plate 19. The locking plate 19 is a member configured to hold the holder 11, the first heating unit 12 and the second heating unit 13. In the example shown in FIG. 1B and FIG. 2, the locking plate 19 is configured by being fitted to the flange 16. The first heating unit 12, the second heating unit 13, and the bottom plate 17 are fixed to the locking plate 19. Since the strength of the structure of the main unit 10 is further increased by the locking plate 19, the main unit 10 is prevented from becoming damaged easily.

The thermal cycler 1 may include the lid 50. In the example shown in FIG. 1A and FIG. 3, the lid 50 is provided so as to cover the holder 11. With the holder 11 covered with the lid 50, heat radiation from the thermal cycler 1 to the outside is inhibited when being heated by the first heating unit 12, the temperature in the thermal cycler 1 can be stabilized. The lid 50 may be fixed to the main unit 10 by a locking part 51. In this embodiment, the locking part 51 is a magnet. The locking part 51 is not limited thereto, and may be a hinge or a catch clip. In the example shown in FIG. 1B and FIG. 2, a magnet is provided on part of a surface of the main unit 10 where the lid 50 comes into contact. Although not shown in FIG. 1B and FIG. 2, a magnet is also provided on the lid 50 at a position where the magnet of the main unit 10 comes into contact. When the holder 11 is covered with the lid 50, the lid 50 is fixed to the main unit 10 by a magnetic force. Accordingly, the lid 50 is prevented from coming off or moving when the main unit 10 is driven by the driving unit 20. Therefore, since the temperature in the thermal cycler 1 can be prevented from changing because the lid 50 comes off from the main unit 10, a more accurate thermal cycle may be applied to the reaction mixture 140 described later.

The main unit 10 preferably has a structure having a high hermeticity. When the main unit 10 has the structure having the high hermeticity, air in the interior of the main unit 10 can hardly be released to the outside of the main unit 10, and hence the temperature in the main unit 10 is well stabilized. In this embodiment, as shown in FIG. 2, a space in the interior of the main unit 10 is hermetically closed by two of the flanges 16, the bottom plate 17, two of the locking plate 19, and the lid 50.

The locking plate 19, the bottom plate 17, the lid 50, and the flange 16 are preferably formed of the heat-insulating material. Accordingly, heat radiation from the main unit 10 to the outside can be further inhibited, and hence the temperature in the interior of the main unit 10 can be further stabilized.

The thermal cycler 1 preferably includes a structure in which the reaction chamber 100 is held at a predetermined position with respect to the first heating unit 12 and the second heating unit 13. Accordingly, a predetermined area of the reaction chamber 100 can be heated by the first heating unit 12 and the second heating unit 13. More specifically, the first portion 111 and the second portion 112 of the channel 110 which constitutes the reaction chamber 100 can be heated by the first heating unit 12 and the second heating unit 13, respectively. In this embodiment, the structure which determines the position of the reaction chamber 100 is the bottom plate 17. As indicated in FIG. 3, when the reaction chamber 100 is inserted to a position in contact with the bottom plate 17, the reaction chamber 100 can be held at the predetermined position with respect to the first heating unit 12 and the second heating unit 13.

The structure which determines the position of the reaction chamber 100 may be of any type as long as the reaction chamber 100 can be held at the desired position. The structure which determines the position of the reaction chamber 100 may be a structure provided in the thermal cycler 1, a structure provided in the reaction chamber 100, or a combination thereof. For example, a screw, a rod to be inserted, a structure having a projection provided on the reaction chamber 100, and a structure in which the holder 11 and the reaction chamber 100 are fitted to each other may be employed. When employing the screw or the rod, the position of holding may be configured to be adjustable according to reaction conditions of the thermal cycle or the size of the reaction chamber 100 by changing the length of the screw, the length of a portion being screwed and a position where the rod is to be inserted.

The thermal cycler 1 may have a mechanism to maintain the temperature of the main unit 10 constant. Accordingly, since the temperature of the reaction chamber 100 is further stabilized, a more accurate thermal cycle can be caused in the reaction mixture 140. As a mechanism to maintain the temperature of the main unit 10, for example, a constant temperature reservoir may be employed.

The spacer 14 and the locking plate 19 shown in FIG. and FIG. 3 may be transparent. Accordingly, when the transparent reaction chamber 100 is used in a thermal cycle process, a state in which the reaction mixture 140 is moved can be observed from the outside of the apparatus. Therefore, whether or not the thermal cycle process is performed adequately can be visually observed. Therefore, the extent of "transparent" in this case may be an extent to which the movement of the reaction mixture 140 can visually be observed when these members are employed in the thermal cycler 1 and the thermal cycle process is performed.

The content of the thermal cycler 1 may be observed by employing the transparent spacer 14 and eliminating the locking plate 19, by employing the transparent locking plate 19 and eliminating the spacer 14, or by eliminating the spacer 14 and the locking plate 19. The less the number of members present between an observer and the reaction chamber 100 to be observed, the less the effect of refraction of light caused by substances is resulted. Therefore, the observation of the interior is facilitated. Since the number of members is reduced by eliminating at least one of the spacer 14 and the locking plate 19, the manufacturing cost may be reduced.

Although the example in which the thermal cycler 1 includes the lid 50 has been described in this embodiment, the lid 50 may not be provided. Accordingly, the number of members to be used may be reduced, so that the manufacturing cost may be reduced.

Figure 8:
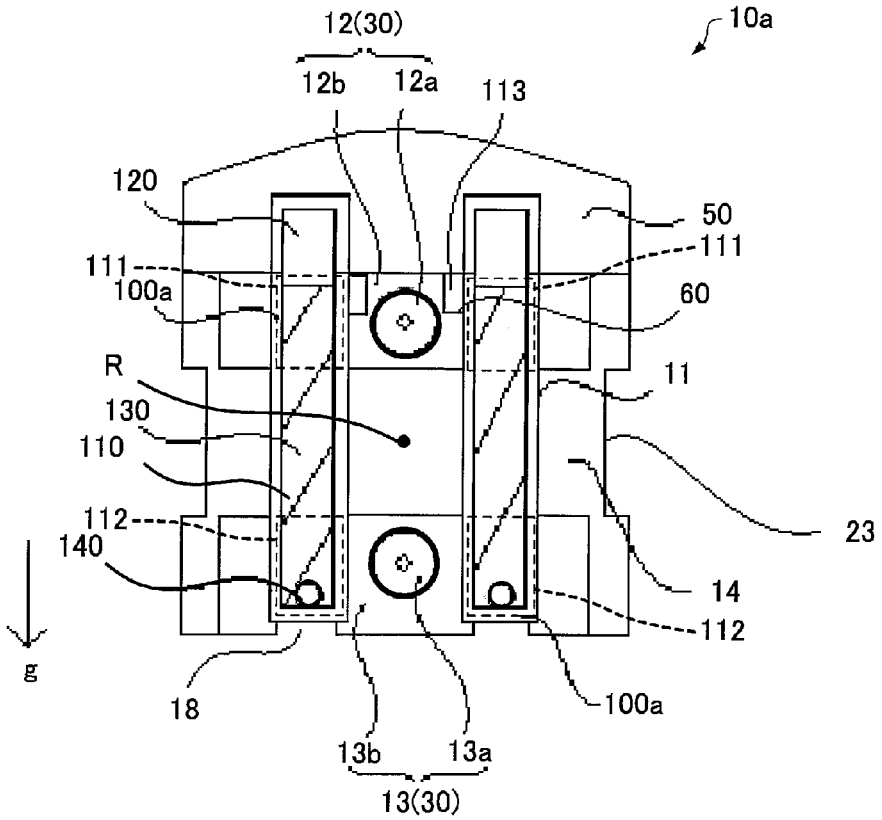
FIG. 8 is a cross-sectional view diagrammatically showing a section taken along a plane passing through a line B-B and perpendicular to an axis of rotation in FIG. 7A.

Although the example in which the thermal cycler 1 includes the bottom plate 17 has been described in this embodiment, the bottom plate 17 may not be provided as shown in FIG. 8. Accordingly, the number of members to be used may be reduced, so that the manufacturing cost may be reduced.

2. Positional Relationship Between Axis of Rotation and Holder

Referring now to FIG. 3, the positional relationship between the axis of rotation R and the holder 11 will be described. When the thermal cycler 1 is projected on a plane perpendicular to the axis of rotation R (in other words, in a cross-sectional view of the thermal cycler 1 taken along a plane perpendicular to the axis of rotation R), a maximum distance from the axis of rotation R to a point in the channel 110 (a distance d1 in FIG. 3) is smaller than a maximum distance connecting two points in the channel 110 (a distance d2 in FIG. 3).

FIG. 3 is a cross-sectional view diagrammatically showing a cross-section taken along the plane passing through the line A-A in FIG. 1A and perpendicular to the axis of rotation R, the distance dl and the distance d2 are substantially equivalent to a drawing of the main unit 10 of the thermal cycler 1 projected on the plane perpendicular to the axis of rotation R. Therefore, in the description given below, the distance d1 and the distance d2 are described with reference to FIG. 3.

The distance d1 shows a distance from the axis of rotation R to a point among the points selected from the interior of the channel 110 at a longest distance from the axis of rotation R in the plane perpendicular to the axis of rotation R on which the thermal cycler 1 is projected. The distance d2 shows a distance between two points having a maximum distance from each other selected from the interior of the channel 110 in the plane perpendicular to the axis of rotation R on which the thermal cycler 1 is projected. In FIG. 3, since the cross section of the channel 110 is a rectangular shape, the distance dl is a distance from a point indicating the axis of rotation R and a point at a lower right corner of the rectangular, and the distance d2 corresponds to the length of a diagonal line of the rectangular. Therefore, the distance dl is smaller than the distance d2.

According to the embodiment, since the axis of rotation R has a component perpendicular to the direction in which the gravitational force acts, and has a component perpendicular to the direction of movement of the reaction mixture 140 in the channel 110 of the reaction chamber 100 when the reaction chamber 100 is loaded in the holder 11, the positions of a lowermost point and/or an uppermost point in the direction in which the gravitational force acts in the channel 110 of the reaction chamber 100 loaded in the holder 11 change by the rotation of the holder 11 by the driving unit 20. Accordingly, the reaction mixture 140 moves in the channel 110 in which the temperature gradient is formed by the temperature gradient forming unit 30. Therefore, the thermal cycle may be applied to the reaction mixture 140. According to the embodiment, when being projected on the plane perpendicular to the axis of rotation R, the maximum distance dl from the axis of rotation R to the point in the channel 110 of the reaction chamber 100 is smaller than the maximum distance d2 connecting the two points in the channel 110 of the reaction chamber 100, and hence the radius of rotation by the driving unit 20 can be reduced. Therefore, the thermal cycler suitable for reduction in size is realized.

As shown in FIG. 3, in the thermal cycler 1, the holders 11 include first holders 11*a* and second holders 11*b* where the reaction chambers 100 are loaded respectively, and the direction of movement of the reaction mixture 140 in the reaction chamber 100 loaded in the first holder 11*a* and the direction of movement of the reaction mixture 140 in the reaction chamber 100 loaded in the second holder 11*b* may be parallel to each other. Here, the term "parallel" includes not only a state of completely parallel, but also a state close to parallel to an extent which can ensure a predetermined accuracy as the thermal cycler. When the holders 11 have a configuration in which three or more reaction chambers 100 can be loaded, the first holder 11*a* and the second holder 11*b* may be portions from among the holders 11 in which two arbitrarily selected reaction chambers 100 can be loaded.

According to the embodiment, the direction of movement of the reaction mixture 140 in the reaction chamber 100 to be loaded in the first holder 11*a* and the direction of movement of the reaction mixture 140 in the reaction chamber 100 loaded in the second holder 11*b* are parallel to each other, when the holder 11 is rotated by the driving unit 20 about the axis of rotation R, the reaction mixture 140 in the reaction chamber 100 loaded in the first holder 11*a* and the reaction mixture 140 in the reaction chamber 100 loaded in the second holder 11*b* move at the same timing. In other words, the time of the start of the movement of the two reaction mixtures 140 can be synchronized. Therefore, the thermal cycle under the same temporal conditions may be applied to the reaction chamber 100 loaded in the first holder 11*a* and the reaction chamber 100 loaded in the second holder 11*b* at the same timing. The extent of the "same" in this case is a range which does not affect the accuracy of the reaction.

As shown in FIG. 3, in the thermal cycler 1, when being projected on the plane perpendicular to the axis of rotation R, the first holder 11*a* and the second holder 11*b* may be positioned at different positions.

According to this embodiment, when being projected on the plane perpendicular to the axis of rotation R, the first holder 11*a* and the second holder 11*b* can be relatively disposed in a direction other than the depth direction as viewed from the direction of the axis of rotation R because the first holder 11*a* and the second holder 11*b* are at different positions. Accordingly, the size of the apparatus in the direction depth as viewed from the axis of rotation R can be reduced. Therefore, the thermal cycler suitable for reduction in size is realized.

As shown in FIG. 3, in the thermal cycler 1, when being projected on the plane perpendicular to the axis of rotation R, the axis of rotation R may be located at an area interposed between the first holder 11*a* and the second holder 11*b*. In other words, in the thermal cycler 1, the axis of rotation R may be positioned between the first holder 11*a* and the second holder 11*b* in a cross-sectional view of the thermal cycler 1 taken along the plane perpendicular to the axis of rotation R.

According to this embodiment, since the axis of rotation R is positioned in the area interposed between the first holder 11*a* and the second holder 11*b* when being projected on the plane perpendicular to the axis of rotation R, the radius of rotation caused by the driving unit 20 may be reduced even when the holder 11 includes the first holder 11*a* and the second holder 11*b*. Therefore, the thermal cycler suitable for reduction in size is realized.

Figure 4:
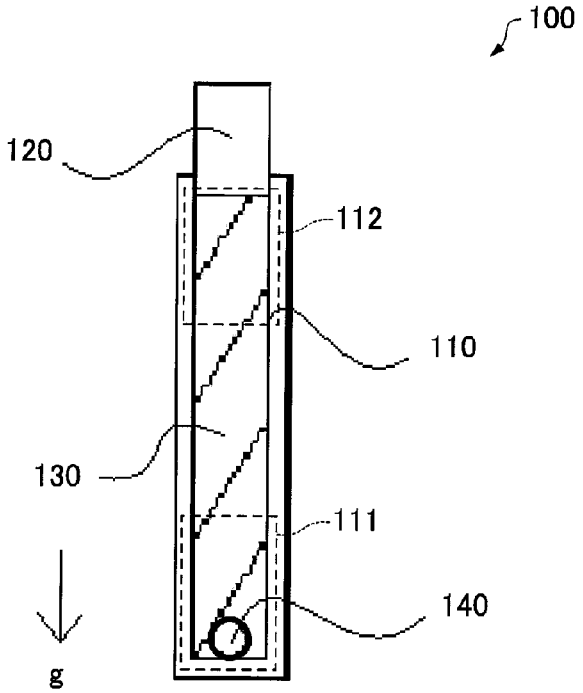
FIG. 4 is a cross-sectional view showing a configuration of a reaction chamber which is to be loaded in the thermal cycler according to the first embodiment.

3. Configuration of Reaction Chamber to be Loaded in Thermal Cycler According to First Embodiment FIG. 4 is a cross-sectional view showing a configuration of the reaction chamber 100 which is to be loaded in the thermal cycler 1 according to the first embodiment. In FIG. 4, the arrow g shows the direction in which the gravitational force acts.

The reaction chamber 100 is filled with the reaction mixture 140 and the liquid 130 which is different from the reaction mixture 140 in specific gravity and is immiscible with the reaction mixture 140 (hereinafter, referred to as "liquid 130"), and includes the channel 110 in which the reaction mixture 140 moves along the opposed inner walls. In this embodiment, the liquid 130 is smaller in specific gravity than the reaction mixture 140, and is liquid which is immiscible with the reaction mixture 140. For example, liquid which is immiscible with the reaction mixture 140 and has a specific gravity smaller than that of the reaction mixture 140 may be employed as the liquid 130. In the example shown in FIG. 4, the reaction chamber 100 includes the channel 110 and a seal 120. The channel 110 is filled with the reaction mixture 140 and the liquid 130, and is sealed by the seal 120.

The channel 110 is formed so that the reaction mixture 140 is moved along the opposed inner walls. Here, the term "opposed inner walls" of the channel 110 means two areas of a wall surface of the channel 110 having an opposed positional relationship. The term "along" means a state being close in terms of the distance between the reaction mixture 140 and the wall surface of the channel 110, and includes a state in which the reaction mixture 140 comes into contact with the wall surfaces of the channel 110. Therefore, the term "the reaction mixture 140 moves along the opposed inner walls" means that "the reaction mixture 140 moves in a state of being close in distance to both of two areas of the wall surface of the channel 110 having an opposed positional relationship". In other words, the distance between the opposed two inner walls of the channel 110 is a distance sufficient to cause the reaction mixture 140 to move along the inner walls.

With the channel 110 of the reaction chamber 100 in such a shape, the direction of movement of the reaction mixture 140 in the channel 110 can be controlled, so that a route of the movement of the reaction mixture 140 in the channel 110 can be controlled to some extent. Accordingly, the time required for the reaction mixture 140 to move in the channel 110 can be controlled to some extent. Therefore, the distance between the two opposed inner walls of the channel 110 is preferably an extent in which fluctuations of thermal cycle conditions applied to the reaction mixture 140 caused by fluctuations in time of movement of the reaction mixture 140 in the channel 110 can satisfy a desired accuracy, that is, an extent in which the result of reaction can satisfy the desired accuracy. More specifically, the distance between the two opposed inner walls of the channel 110 in the direction perpendicular to the direction of movement of the reaction mixture 140 is desirably an extent which does not allow entry of two or more liquid drops of the reaction mixture 140.

In the example shown in FIG. 4, the outer shape of the reaction chamber 100 is a column shape, and the channel 110 having a longitudinal direction in the direction along a center axis (the vertical direction in FIG. 4) is formed therein. The shape of the channel 110 is a column shape having a circular cross section in the direction perpendicular to the longitudinal direction of the channel 110, that is, in the direction perpendicular to the direction of movement of the reaction mixture 140 in an area in the channel 110 (this cross section is defined as the "cross section" of the channel 110). Therefore, in the reaction chamber 100, the opposed inner walls of the channel 110 are an area including two points on the wall surface of the channel 110 opposed with the intermediary of the center of the cross section of the channel 110. Also, "the direction of the movement of the reaction mixture 140" corresponds to the longitudinal direction of the channel 110.

The shape of the cross section of the channel 110 is not limited to the circular shape, and is arbitrary as long as the reaction mixture 140 can move along the opposed inner walls such as a polygonal shape or an oval shape. For example, if the cross section of the channel 110 of the reaction chamber 100 is a polygonal shape, the "opposed inner walls" are opposed inner walls of the channel assuming that the cross section inscribing the channel 110 has a circular shape. In other words, what is required is only that the channel 110 is formed so as to allow the reaction mixture 140 to flow along the opposed inner wall of an imaginary channel having a circular cross section inscribing the channel 110. Accordingly, in the case where the cross section of the channel 110 has a polygonal shape, the route of the reaction mixture 140 moving between the first portion 111 and the second portion 112 may be defined to some extent. Therefore, time required for the reaction mixture 140 to move between the first portion 111 and the second portion 112 can be controlled to some extent.

The first portion 111 of the reaction chamber 100 is an area of part of the channel 110 heated to the first temperature by the first heating unit 12. The second portion 112 is an area of part of the channel 110 heated to the second temperature different from the first temperature by the second heating unit 13 and different from the first portion 111. In the example shown in FIG. 4, the first portion 111 is an area including one of ends of the channel 110 in the longitudinal direction, and the second portion 112 is an area including the other end of the channel 110 in the longitudinal direction. In the example shown in FIG. 4, an area surrounded by a dot line including the end of the channel 110 relatively far from the seal 120 corresponds to the first portion 111, and an area surrounded by a dot line including the end of the channel 110 relatively close to the seal 120 corresponds to the second portion 112. The thermal cycler 1 according to this embodiment forms a temperature gradient in the direction of movement of the reaction mixture 140 with respect to the channel 110 of the reaction chamber 100 by heating the first portion 111 of the reaction chamber 100 to the first temperature by the first heating unit 12 of the temperature gradient forming unit 30 and heating the second portion 112 of the reaction chamber 100 to the second temperature by the second heating unit 13 of the temperature gradient forming unit 30.

The channel 110 is filled with the liquid 130 and the reaction mixture 140. Since the liquid 130 is immiscible with the reaction mixture 140, that is, has a nature which is not mixed with the reaction mixture 140, the reaction mixture 140 is held in a state of droplets in the liquid 130 as shown in FIG. 4. Since the reaction mixture 140, being larger in specific gravity than the liquid 130, is positioned in a lowest area in the direction in which the gravitational force of the channel 110 acts. Examples of the liquid 130 which may be used include dimethyl silicone oil and paraffin oil. The reaction mixture 140 is a liquid including components required for reaction. When the reaction is PCR, the reaction mixture 140 contains DNA (target nucleic acid) amplified by PCR, DNA polymerase required for amplifying DNA, primer and the like. For example, when performing PCR using oil as the liquid 130, the reaction mixture 140 is preferably solution containing the above-described components.

4. Example of Thermal Cycle Procedure of Thermal Cycler

Subsequently, an example of a thermal cycle procedure of the thermal cycler 1 according to the first embodiment will be described. In the following description, an example of control of the driving unit 20 which rotates the holder 11 and the temperature gradient forming unit 30 between a first disposition and a second disposition different from the first disposition in a position of a lowermost point in the channel 110 in the direction in which the gravitational force acts when the reaction chamber 100 is loaded in the holder 11 will be described.

Figure 5A:
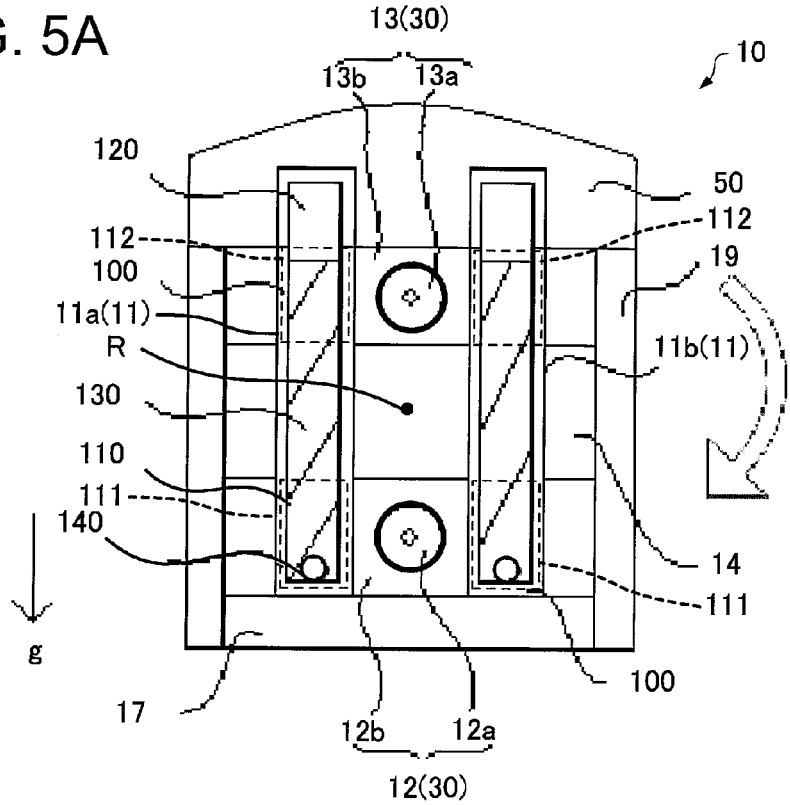
FIG. 5A is a cross-sectional view diagrammatically showing a section taken along a plane passing through the line A-A and perpendicular to the axis of rotation in FIG. 1A in a first disposition.
Figure 5B:
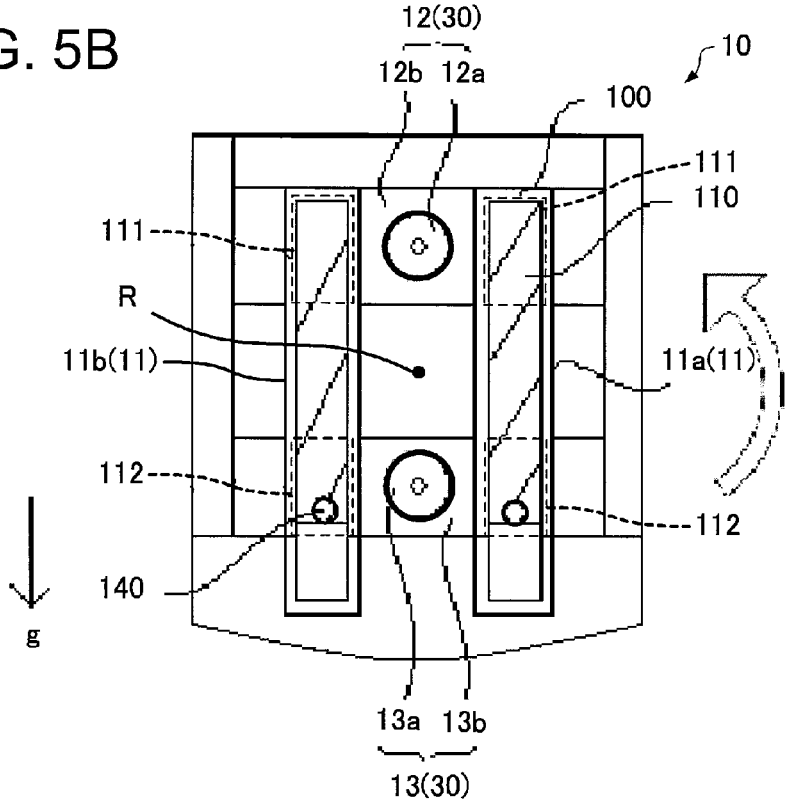
FIG. 5B is a cross-sectional view diagrammatically showing a section taken along a plane passing through the line A-A and perpendicular to the axis of rotation in FIG. 1A in a second disposition.

FIG. 5A is a cross-sectional view diagrammatically showing a section taken along a plane passing through the line A-A in FIG. 1A and perpendicular to the axis of rotation R in the first disposition, and FIG. 5B is a cross-sectional view diagrammatically showing a section taken along a plane passing through the line A-A in FIG. 1A and perpendicular to the axis of rotation R in the second disposition. In FIG. 5A and FIG. 5B, hollow arrows indicate the direction of rotation of the main unit 10, and the arrows g indicate the direction in which the gravitational force acts.

As shown in FIG. 5A, the first disposition is a disposition in which the end of the channel 110 relatively far from the seal 120 comes to the lowermost point in the direction in which the gravitational force acts. In other words, the first disposition is a disposition in which the first portion 111 of the reaction chamber 100 is positioned at the lowermost portion of the channel 110 in the direction in which the gravitational force acts when the reaction chamber 100 is loaded in the holder 11. In the example shown in FIG. 5A, the reaction mixture 140 having a specific gravity larger than that of the liquid 130 exists in the first portion 111 in the first disposition. Therefore, the reaction mixture 140 is placed under the first temperature.

As shown in FIG. 5B, the second disposition is a disposition in which the end of the channel 110 relatively close to the seal 120 comes to the lowermost point in the direction in which the gravitational force acts. In other words, the second disposition is a disposition in which the second portion 112 of the reaction chamber 100 is positioned at the lowermost portion of the channel 110 in the direction in which the gravitational force acts when the reaction chamber 100 is loaded in the holder 11. In the example shown in FIG. 5B, the reaction mixture 140 having a specific gravity larger than that of the liquid 130 exists in the second portion 112 in the second disposition. Therefore, the reaction mixture 140 is placed under the second temperature.

In this manner, the thermal cycle may be applied to the reaction mixture 140 by the rotation of the holder 11 and the temperature gradient forming unit 30 between the first disposition and the second disposition which is different from the first disposition caused by the driving unit 20.

The driving unit 20 may reciprocally rotate the holder 11 and the temperature gradient forming unit 30 in opposite directions between the case of rotating from the first disposition to the second disposition and the case of rotating from the second disposition to the first disposition. Accordingly, a specific mechanism for reducing a kink in the wiring such as the conductor wire 15 caused by the rotation is not necessary. Therefore, the thermal cycler suitable for reduction in size is realized. Also, the number of rotations in the case of rotating from the first disposition to the second disposition and the number of rotations in the case of rotating from the second disposition to the first disposition are preferably less than one turn (the angle of rotation is smaller than 360°). Accordingly, the degree of any kink in the wiring may be reduced.

Subsequently, an example of the thermal cycle procedure of the thermal cycler 1 according to the first embodiment will be described further in detail on the basis of an example of a case where a shuttle PCR (two-stage temperature PCR) is performed as an example of a thermal cycle process. The shuttle PCR is a method of amplifying the nucleic acid in the reaction mixture by applying a two-stage temperature process between a high temperature and a low temperature repeatedly to the reaction mixture. In the process at the high temperature, denaturing of a double strand DNA is performed and in the process at the low temperature, annealing (a reaction of a primer coupled to a single-strand DNA) and an extension reaction (a reaction of forming a complementary strand of DNA from the primer as a starting point) are performed. In general, the high temperature is a temperature between 80° C. and 100° C. and the low temperature is a temperature between 50° C. and 75° C. in the shuttle PCR. The processes in the respective temperatures are performed for a predetermined time and time to be held at the high temperature is generally shorter than time to be held at the low temperature. For example, the high temperature may be held for 1 to 10 seconds, and the low temperature may be held for 10 seconds to 60 seconds, or may be longer or shorter than the time described above depending on the conditions of the reaction. For reference sake, since the adequate time, the temperature, and the number of cycles (the number of times to repeat the high temperature and the low temperature) are different depending on the type or the amount of the reagent to be used, it is preferable to determine an adequate protocol while considering the type of the reagent or the amount of the reaction mixture 140 before performing the reaction.

Figure 6:
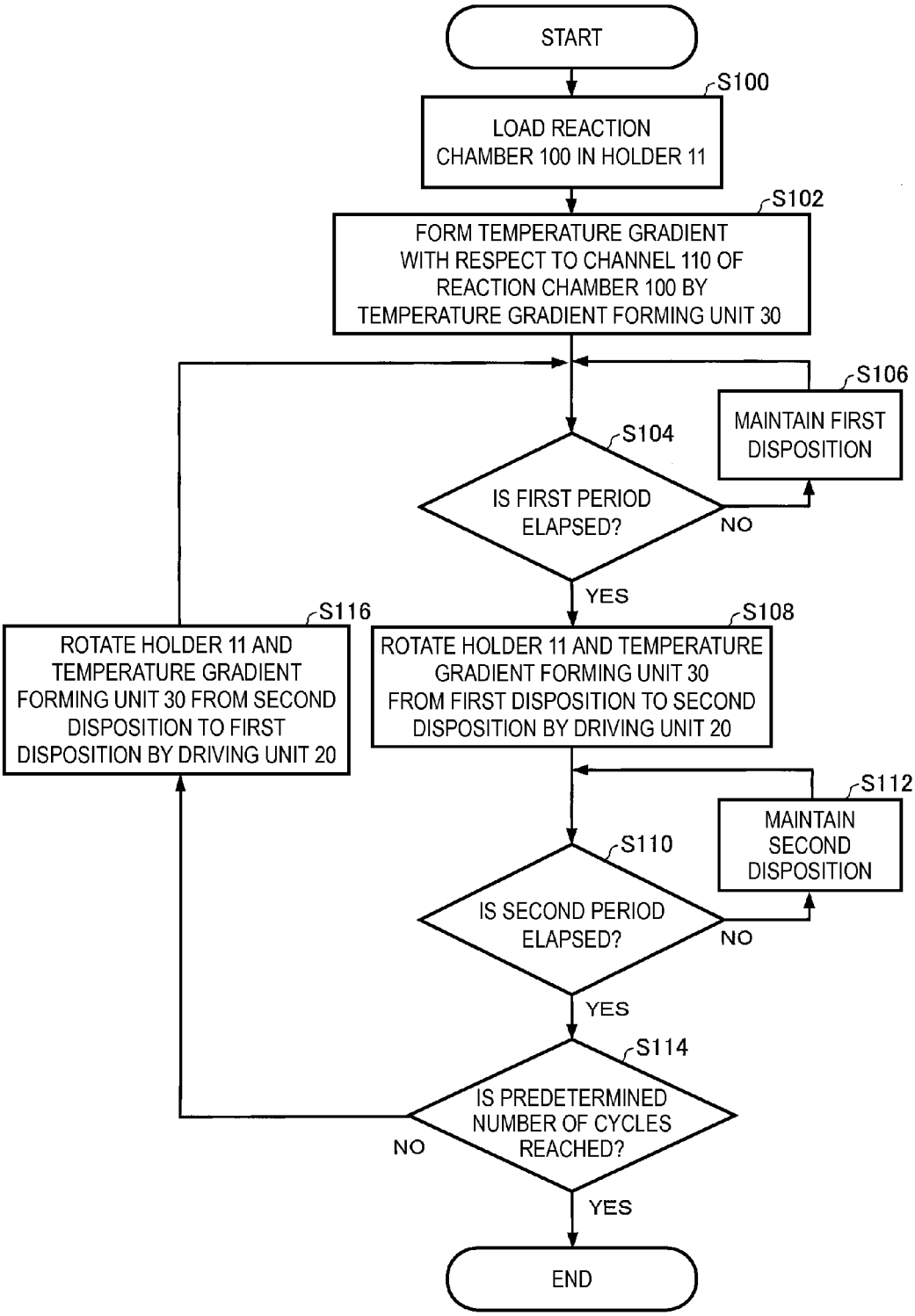
FIG. 6 is a flowchart showing an example of a thermal cycle procedure of the thermal cycler according to the first embodiment.

FIG. 6 is a flowchart showing an example of the thermal cycle procedure of the thermal cycler 1 according to the first embodiment.

First of all, the reaction chamber 100 is loaded in the holder 11 (Step S100). In this embodiment, after the reaction mixture 140 has introduced into the channel 110 filled with the liquid 130, the reaction chamber 100 sealed with the seal 120 is loaded in the holder 11. Introduction of the reaction mixture 140 may be performed using a micropipette, an ink jet pipetting device or the like. In this embodiment, in a state in which the reaction chamber 100 is loaded in the holder 11, the first heating unit 12 is in contact with the reaction chamber 100 at a position including the first portion 111 and the second heating unit 13 is in contact with the reaction chamber 100 at a position including the second portion 112. In this embodiment, as shown in FIG. 5A, by loading the reaction chamber 100 so as to come into contact with the bottom plate 17, the reaction chamber 100 can be held at the predetermined position with respect to the first heating unit 12 and the second heating unit 13. In this embodiment, it is assumed that the holder 11 and the temperature gradient forming unit 30 are disposed in the first disposition immediately after the reaction chamber 100 has been loaded in the holder 11.

After Step S100, a temperature gradient is formed with respect to the channel 110 of the reaction chamber 100 by the temperature gradient forming unit 30 (Step S102). In this embodiment, by heating of the reaction chamber 100 by the first heating unit 12 and the second heating unit 13, the temperature gradient is formed with respect to the channel 110 of the reaction chamber 100. The first heating unit 12 and the second heating unit 13 heat the different portions of the reaction chamber 100 to different temperatures. In other words, the first heating unit 12 heats the first portion 111 to the first temperature, and the second heating unit 13 heats the second portion 112 to the second temperature. Accordingly, a temperature gradient in which the temperature changes between the first temperature and the second temperature is formed between the first portion 111 and the second portion 112 of the channel 110. In this embodiment, the first temperature is a relatively high temperature from among temperatures suitable for a reaction intended in the thermal cycle process, and the second temperature is a relatively low temperature from among the temperatures suitable for the reaction intended in the thermal reaction process. Therefore, in Step S102 in this embodiment, a temperature gradient in which the temperature is decreased from the first portion 111 to the second portion 112 is formed. The thermal cycle process in this embodiment is the shuttle PCR, and hence the first temperature is preferably a temperature suitable for the denaturing of the double-strand DNA, and the second temperature is preferably a temperature suitable for the annealing and the extension reaction.

Since the holder 11 and the temperature gradient forming unit 30 is disposed in the first disposition in Step S102, if the reaction chamber 100 is heated in Step S102, the reaction mixture 140 is heated to the first temperature. Therefore, in Step S102, the reaction at the first temperature is started for the reaction mixture 140.

Whether or not a first period has elapsed in the first disposition is determined after Step S102 (Step S104). In this embodiment, the controller, not shown, determines whether or not the first period has elapsed. The first period is a period to hold the holder 11 and the temperature gradient forming unit 30 in the first disposition. In this embodiment, when the thermal cycler 1 is activated after the reaction chamber 100 has been loaded in Step S100, the determination of whether or not the time after the thermal cycler 1 has been activated has reached the first period may be performed in Step S104, which is performed at the beginning after the reaction chamber 100 has been loaded in Step S100. Since the reaction mixture 140 is heated to the first temperature in the first disposition, the reaction mixture 140 is preferably brought into reaction at the first temperature in the intended reaction during the first period. In this embodiment, the first period is preferably set to a period required for the denaturing of the double-strand DNA.

In Step S104, if it is determined that the first period has not elapsed (No in Step S104), the first disposition is maintained (Step S106). After Step S106, Step 104 and Step 106 are repeated until the first period is determined to have elapsed in Step S104.

In Step S104, if it is determined that the first period has elapsed (Yes in Step S104), the holder 11 and the temperature gradient forming unit 30 are rotated from the first disposition to the second disposition by the driving unit 20 (Step S108). In the thermal cycler 1 in this embodiment, the holder 11 and the temperature gradient forming unit 30 are rotated from the first disposition to the second disposition about the identical axis of rotation R by driving the main unit 10 to be rotated by the driving unit 20 under the control of the controller. In this embodiment, when the flange 16 is rotated by being driven by the motor about the drive shaft as the axis of rotation R, the holder 11 and the temperature gradient forming unit 30 fixed to the flange 16 are rotated. Since the axis of rotation R is an axis in the direction having a component perpendicular to the direction of movement of the reaction mixture 140, the holder 11 and the temperature gradient forming unit 30 are rotated when the drive shaft is rotated by the activation of the motor. In the example shown in FIGS. 5A and 5B, the driving unit 20 rotates the main unit 10 about the axis of rotation R by 180°.

In Step S108, since the holder 11 and the temperature gradient forming unit 30 are disposed in the second disposition, which is opposite from the first disposition in positional relationship between the first portion 111 and the second portion 112 in the direction in which the gravitational force acts, the reaction mixture 140 moves from the first portion 111 to the second portion 112 by the action of the gravitational force. When the controller stops the operation of the driving unit 20 when the holder 11 and the temperature gradient forming unit 30 reach the second disposition, the disposition of the holder 11 and the temperature gradient forming unit 30 is held in the second disposition.

Whether or not a second period has elapsed in the second disposition is determined after step S108 (Step S110). In this embodiment, the controller, not shown, determines whether or not the second period has elapsed. In this embodiment, since the second portion 112 is heated to the second temperature in Step S102, in Step S110, whether or not a time period from the moment when the disposition of the holder 11 and the temperature gradient forming unit 30 reaches the second disposition in Step S108 has reached the second period may be determined. The second period is a period to hold the holder 11 and the temperature gradient forming unit 30 in the second disposition. Since the reaction mixture 140 is heated to the second temperature in the second disposition, the reaction mixture 140 is preferably brought into reaction at the second temperature in the intended reaction during the second period. In this embodiment, the second period is preferably set to a period required for the annealing and the extension reaction.

In Step S110, if it is determined that the second period is not elapsed (No in Step S110), the second disposition is maintained (Step S112). After Step S112, Step S110 and Step S112 are repeated until the second period is determined to have elapsed in Step S110.

In Step S110, if it is determined that the second period has elapsed (Yes in Step S110), whether or not the number of times of the thermal cycle has reached a predetermined number of cycles is determined (Step S114). In this embodiment, the controller, not shown, determines whether or not the number of times of the thermal cycle has reached the predetermined number of cycles. More specifically, whether or not the procedure of Step S110 has completed by a predetermined number of times is determined. In this embodiment, the number of times of completion of Step S110 is determined by the number of determinations of "Yes" in Step S110. When a series of procedure from Step S104 to Step S110 is performed once, one cycle of the thermal cycle is applied to the reaction mixture 140, and the number of times of the completion of Step S110 may be considered to be the number of cycles of the thermal cycle. Therefore, by performing Step S114, whether or not the number of times of the thermal cycle required for the intended reaction has performed with respect to the reaction mixture 140 can be determined.

In Step S114, if it is determined that the number of times of the thermal cycle does not reach the predetermined number of cycles (No in Step S114), the holder 11 and the temperature gradient forming unit 30 are rotated from the second disposition to the first disposition by the driving unit 20 (Step S116). In the thermal cycler 1 in this embodiment, the holder 11 and the temperature gradient forming unit 30 are rotated from the second disposition to the first disposition about the identical axis of rotation R by driving the main unit 10 to be rotated by the driving unit 20 under the control of the controller. In this embodiment, when the flange 16 is driven by the motor to rotate about the drive shaft as the axis of rotation R, the holder 11 and the temperature gradient forming unit 30 fixed to the flange 16 are rotated. Since the axis of rotation R is an axis in the direction having a component perpendicular to the direction of movement of the reaction mixture 140, the holder 11 and the temperature gradient forming unit 30 are rotated when the drive shaft is rotated by the activation of the motor. In the example shown in FIGS. 5A and 5B, the driving unit 20 rotates the main unit 10 about the axis of rotation R by 180°.

After Step S116, Step S104 is performed again. When performing Step S104 after Step S116, whether or not a time period from the moment when the disposition of the holder 11 and the temperature gradient forming unit 30 reaches the first disposition has reached the first period may be determined.

In Step S114, if it is determined that the number of times of the thermal cycle has reached the predetermined number of cycles (Yes in Step S114), the thermal cycle process is ended.

In Step S108 and Step S116, the holder 11 and the temperature gradient forming unit 30 may be rotated in the opposite direction by the driving unit 20. Accordingly, a specific mechanism (for example, a slip ring) for reducing a kink in the wiring such as the conductor wire 15 caused by the rotation is no longer necessary. Therefore, the thermal cycler suitable for reduction in size is realized.

It is also applicable to combine Step S108 and Step S116, and perform the rotation in the same direction a plurality of times and then perform the rotation in the opposite direction the same number of times. Accordingly, since any kink generated in the wiring can be eliminated, a specific mechanism (for example, a slip ring) for reducing a kink in the wiring such as the conductor wire 15 caused by the rotation is not necessary any longer. Therefore, the thermal cycler suitable for reduction in size is realized.

In the thermal cycler 1 according to this embodiment, the length of time to hold the reaction chamber 100 in the first disposition and the second disposition corresponds to a period of heating of the reaction mixture 140. Therefore, the period of heating the reaction mixture 140 in the thermal cycle process can easily be controlled.

The thermal cycler 1 in this embodiment switches the disposition of the holder 11 and the temperature gradient forming unit 30 from the first disposition to the second disposition when the first period has elapsed, and from the second disposition to the first disposition when the second period has elapsed. Accordingly, the reaction mixture 140 is heated to the first temperature for the first period and to the second temperature for the second period, and hence the period of heating the reaction mixture 140 can be controlled more accurately. Accordingly, a more accurate thermal cycle can be applied to the reaction mixture 140.

In the example of the thermal cycle procedure described above, the first temperature and the second temperature are set to be constant from the beginning of the thermal cycle process to the end. However, at least one of the first temperature and the second temperature may be changed during the process. In other words, the temperature gradient forming unit 30 may be configured to be capable of forming a plurality of patterns of temperature gradients. The first temperature and the second temperature may be changed by the control of the temperature gradient forming unit 30 by the controller. Therefore, a reaction which requires a combination of two or more types of temperatures like a reverse transfer PCR (RT-PCR, the outline of the reaction will be described later in the section of "6. Examples".) can be performed without increasing the number of heaters which constitute the temperature gradient forming unit 30 or making the structure of the apparatus complicated.

In the example of the thermal cycle procedure described above, an example in which the angle of rotation when switching the disposition of the holder 11 and the temperature gradient forming unit 30 by rotation of the driving unit 20 is 180° has been described. However, the angle of rotation may be any angle which changes the position where the reaction mixture 140 exists with respect to the temperature gradient in the channel 110. For example, if the angle of rotation is smaller than 180°, the speed of movement of the reaction mixture 140 is reduced. Therefore, by adjusting the angle of rotation, a period required for the transition of the temperature of the reaction mixture 140 between the first temperature and the second temperature can be adjusted. In other words, a period of change of the temperature of the reaction mixture 140 from the first temperature to the second temperature can be adjusted.

Figure 7A:
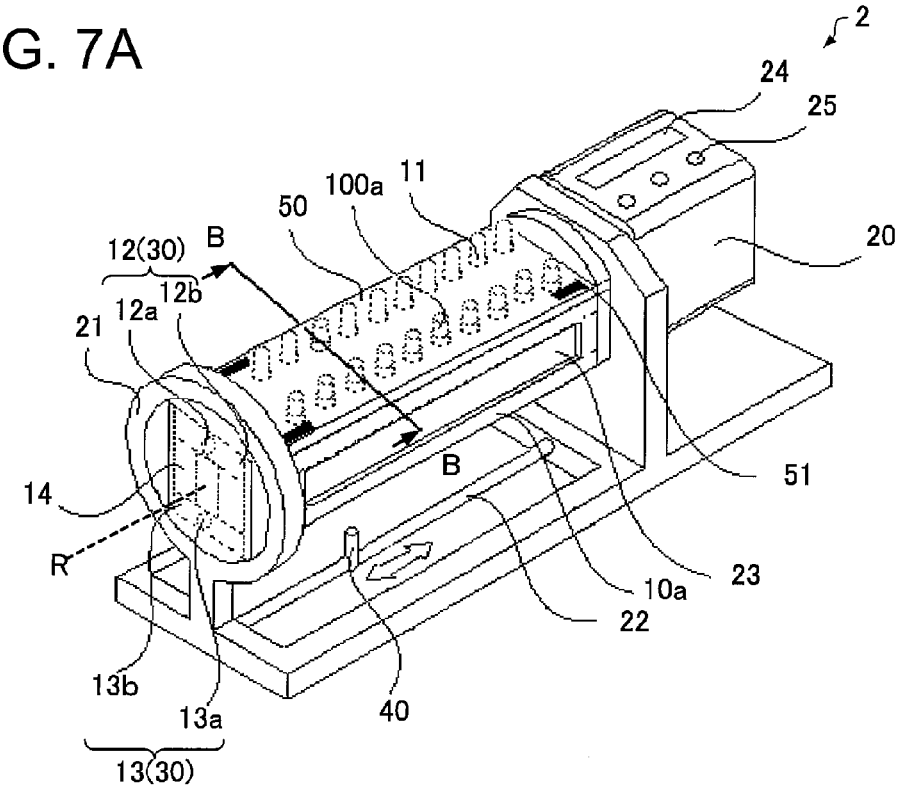
FIG. 7A is a perspective view showing a state in which a lid of a thermal cycler according to a second embodiment is closed.
Figure 7B:
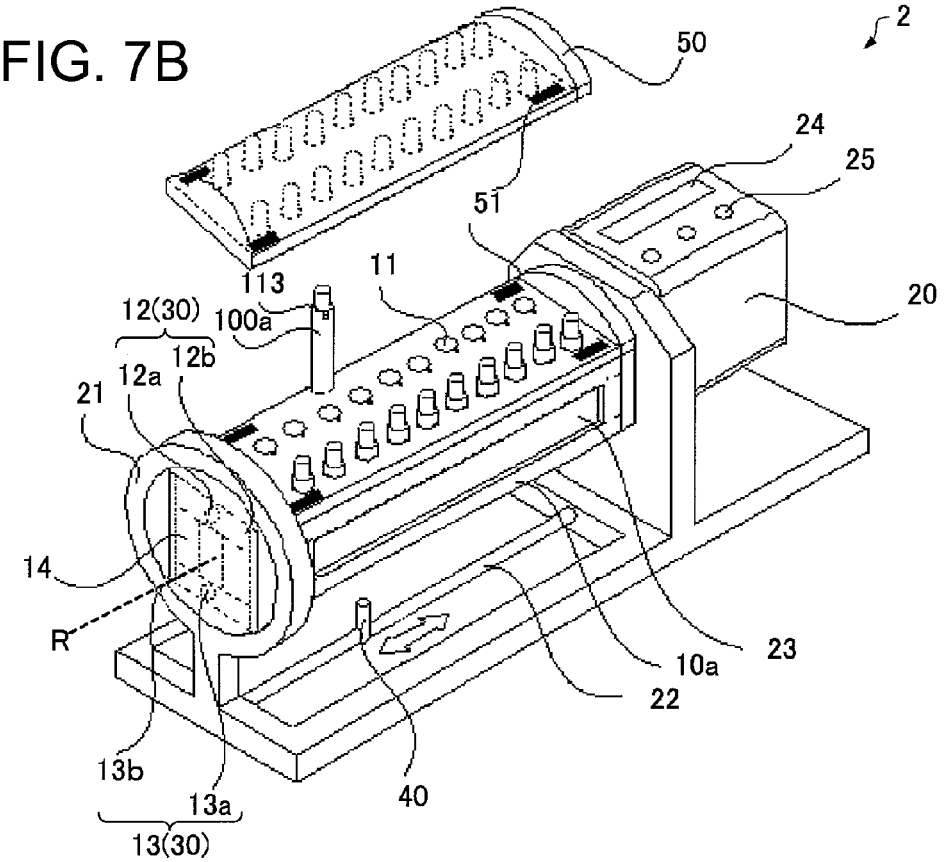
FIG. 7B is a perspective view showing a state in which the lid of the thermal cycler according to the second embodiment is opened.
Figure 9:
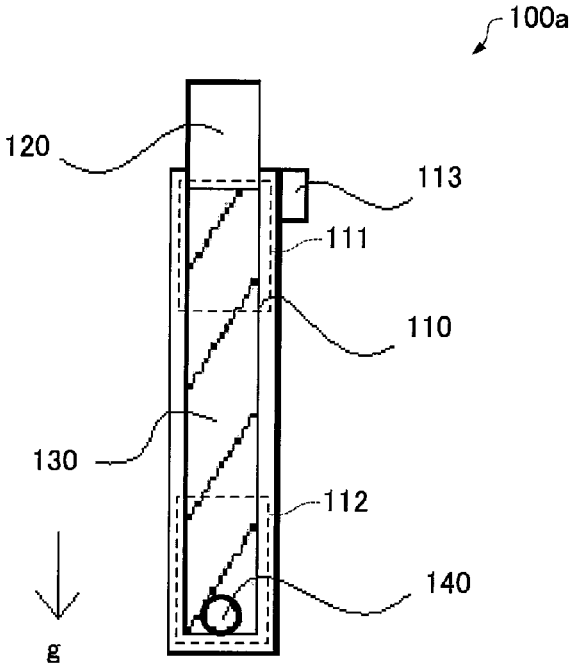
FIG. 9 is a cross-sectional view showing a configuration of a reaction chamber which is to be loaded in the thermal cycler according to the second embodiment.

5. Configurations of Thermal Cycler and Reaction Chamber to be Loaded Therein According to a Second Embodiment FIG. 7A is a perspective view showing a state in which a lid 50 of a thermal cycler 2 according to a second embodiment is closed, and FIG. 7B is a perspective view showing a state in which the lid 50 of the thermal cycler 2 according to the second embodiment is opened. FIG. 8 is a cross-sectional view diagrammatically showing a section taken along a plane passing through a line B-B and perpendicular to the axis of rotation R in FIG. 7A. FIG. 9 is a cross-sectional view showing a configuration of a reaction chamber 100*a* which is to be loaded in the thermal cycler 2 according to the second embodiment. In FIGS. 8 and 9, the arrows g show the directions in which the gravitational force acts. In the description below, a configuration different from the thermal cycler 1 according to the first embodiment will be described in detail, and the same configurations as the thermal cycler 1 according to the first embodiment are designated by the same reference numerals and description will be omitted.

As shown in FIGS. 7A and 7B, in a main unit 10*a* of the thermal cycler 2, the first heating unit 12 is arranged on the side relatively far from the bottom plate, and the second heating unit 13 is arranged on the side relatively close to the bottom plate. In other words, as shown in FIG. 8, the first heating unit 12 is arranged on the side relatively close to the lid 50, and the second heating unit 13 is arranged on the side relatively far from the lid 50.

As shown in FIGS. 7A and 7B, the thermal cycler 2 may include a fluorescent detector 40. Accordingly, the thermal cycler 2 may be used for an application which involves fluorescence detection such as a real time PCR. The number of the fluorescent detectors 40 is arbitrary as long as the detection can be performed without a problem. In the example shown in FIGS. 7A and 7B, the single fluorescent detector 40 is moved along a slide 22 to perform the fluorescence detection. In order to perform the fluorescence detection, a measurement window 18 which allows the fluorescence detection of the interior of the holder 11 is preferably provided on the side of the second heating unit 13 of the main unit 10*a*. Accordingly, the number of members existing between the fluorescent detector 40 and the reaction mixture 140 can be reduced, and hence further adequate fluorescence detection is achieved. In the example shown in FIG. 8, the measurement window 18 is provided on the second heating unit 13 which is provided on the side farther from the lid 50. Accordingly, the fluorescence detection can be performed adequately in the real time PCR, in which the fluorescence detection is performed on the low-temperature side (the temperature in which the annealing and the extension reaction are performed). When performing the fluorescence detection from the side of the lid 50, a design in which the seal 120 and the lid 50 do not impact the measurement is preferable.

In the thermal cycler 2 according to the second embodiment, the reaction chamber 100*a* and the holder 11 are fitted to each other. Examples of the structure in which the reaction chamber 100*a* and the holder 11 are fitted to each other may be a structure in which a projecting portion 113 provided on the reaction chamber 100*a* is fitted to a fixing portion 60 provided on the holder 11 as shown in FIGS. 8 and 9. Accordingly, the orientation of the reaction chamber 100*a* with respect to the temperature gradient forming unit 30 may be maintained constant. Therefore, since the change of the reaction chamber 100*a* in orientation during the thermal cycle can be inhibited, the temperature environment applied to the reaction mixture 140 can be controlled further precisely. Accordingly, a more accurate thermal cycle can be applied to the reaction mixture 140.

The thermal cycler 2 may include an operating unit 25 as shown in FIGS. 7A and 7B. The operating unit 25 is a UI (user interface), and is an apparatus which receives an operation to set thermal cycle conditions. A configuration in which at least one of the first temperature, the second temperature, the first period, the second period, and the number of times of the thermal cycle, for example, can be set as the thermal cycle conditions by operating the operating unit 25 is also applicable. The operating unit 25 is mechanically or electronically interlocked with the controller, and the setting in the operating unit 25 is reflected on the control of the controller. Accordingly, since the thermal cycle conditions applied to the reaction mixture 140 can be changed, and hence a desired thermal cycle can be applied to the reaction mixture 140. The operating unit 25 may be configured to allow the setting of items described above independently, or to allow the controller to set required items when one of the plurality of thermal cycle conditions registered in advance is selected. In the example shown in FIGS. 7A and 7B, the operating unit 25 employs a button system so that the thermal cycle conditions may be set by pressing buttons by item.

The thermal cycler 2 may include a display 24 as shown in FIGS. 7A and 7B. The display 24 is a display device, and displays various items of information relating to the thermal cycler 2. The display 24 may display the thermal cycle conditions set via the operating unit 25 and/or the time and/or the temperature measured during the thermal cycle process. For example, when the setting is performed by operating the operating unit 25, entered conditions, temperatures measured by the temperature sensor during the thermal cycle process, time elapsed in the first disposition and/or the second disposition, and the number of applied thermal cycles may be displayed. Also, when the thermal cycle process is terminated, or when any abnormality occurs in the apparatus, such effect may be displayed. Furthermore, a voice-guided notification may also be employed. By performing the display or the voice-guided notification, a user of the apparatus can understand a progress status or a termination of the thermal cycle process easily.

In the first embodiment, although the example in which the spacer 14 and the locking plate 19 are separate members has been described, the spacer 14 and the locking plate 19 may be integrally formed as shown in FIG. 8. Also, the bottom plate 17 and the spacer 14, or the bottom plate 17 and the locking plate 19 may be formed integrally.

In order to observe the interior of the thermal cycler 2, an observation window 23 may be provided on the main unit 10*a* as shown in FIGS. 7A, 7B and 8. The observation window 23 may be a hole or a slit formed on the spacer 14 and/or the locking plate 19, for example. In the example shown in FIG. 8, the observation window 23 is a depression provided on the transparent spacer 14 formed integrally with the locking plate 19. With the provision of the observation window 23, the thickness of a member existing between an observer and the reaction chamber 100*a* to be observed may be reduced, so that the observation of the interior thereof is easily performed.

The example of the thermal cycle procedure described in section "4. Example of Thermal cycle Procedure of Thermal cycler" may be applied to the thermal cycler 2 according to the second embodiment as well. In the example of the procedure described above, the example in which the first temperature, the second temperature, the first period, the second period, the number of times of the thermal cycle, and the operation of the driving unit 20 are controlled by the controller has been described, at least one of these items may be controlled by the user. In a case where the user controls the first temperature and/or the second temperature, for example, the temperature measured by the temperature sensor may be displayed by the display 24 to allow the user to adjust the temperature by operating the operating unit 25. When the user controls the number of times of the thermal cycle, the user may stop the thermal cycler 2 when the predetermined number of times is reached. The number of cycles may be counted by the user or may be performed by the thermal cycler 2 and displayed on the display 24.

When the user controls the first period and/or the second period, the user determines whether or not the predetermined period has reached, and causes the thermal cycler 2 to switch the disposition of the holder 11 and the temperature gradient forming unit 30. In other words, the user may perform at least part of Step S104 and Step S110, and Step S108 and Step S116 in FIG. 6. The required period may be counted using a timer which is not interlocked with the thermal cycler 2 or the elapsed time may be displayed on the display 24 of the thermal cycler 2. Switching of the disposition may be performed by operating the operating unit 25 (UI) or performed manually by employing a handle in the driving unit 20.

6. Examples

Referring now to examples, the invention will be described in further detail. However, the invention is not limited to the examples.

6-1. First Example: Shuttle PCR

Figure 10:
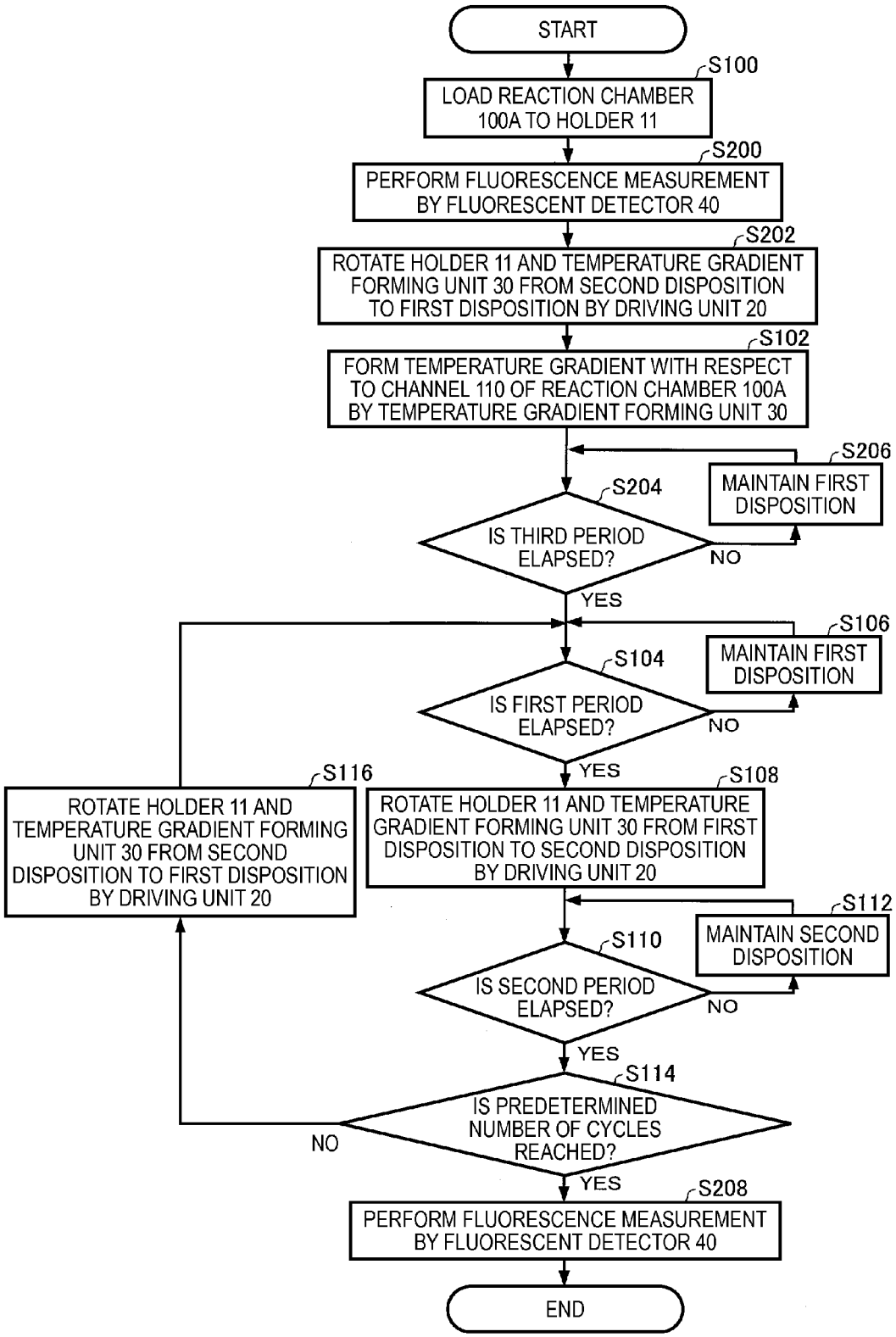
FIG. 10 is a flowchart showing a thermal cycle procedure in a first example.

In this example, the shuttle PCR involving fluorescence measurement using the thermal cycler 2 according to the second embodiment will be described. However, the thermal cycler 1 according to the first embodiment maybe used. FIG. 10 is a flowchart showing a thermal cycle procedure in a first example. In comparison with FIG. 6, the flowchart in FIG. 10 is different in that Step S200, Step S202, Step S204, Step S206 and Step S208 are included. The fluorescent detector 40 in this example is FLE1000 (manufactured by Nippon Sheet Glass Co., LTD.).

The reaction chamber 100*a* in this example has a column shaped outline, and has the column-shaped channel 110 having an inner diameter of 2 mm and a length of 25 mm. The reaction chamber 100*a* is formed of polypropylene having heat resistant properties against temperatures of 100° C. or higher. The channel 110 is filled with approximately 130 μl of dimethyl silicone oil (KF-96L-2cs, manufactured by Shin-Etsu Chemical Co., Ltd.) as the liquid 130. A reaction mixture 140*a* in this example is a mixture of 1 μl of human β actin DNA (the amount of DNA is $10^3$ copy/μl), 10 μl of PCR master mix (Gene Amp Fast PCR Master Mix (2x), manufactured by Applied Biosystems, "GeneAmp" is a registered trademark), 1 μl of primer and probe (Pre-Developed TagMan Assay Reagents Human ACTB, manufactured by Applied Biosystems, "TaqMan" is a registered trademark), 8 μl of PCR Water(Water, PCR Grade, manufactured by Roche Diagnostics). DNA used here is cDNA which is a reversely transcription of commercially available Total RNA (qPCR Human Reference Total RNA, manufactured by Clontech).

First of all, 1 μl of the reaction mixture 140*a* is introduced into the channel 110 using a micropipette. Since the reaction mixture 140*a*, being solution, is immiscible with dimethyl silicone oil described above, and comes into a state of liquid drops having a circular shape of approximately 1.5 mm in diameter in the liquid 130. Since the specific gravity of the above-described dimethyl silicone oil is approximately 0.873 at a temperature of 25° C., the reaction mixture 140*a* (specific gravity of approximately 1.0) is positioned at a lowermost position in the channel 110 in the direction in which the gravitational force acts. Subsequently, one of the ends of the channel 110 is sealed with a plug and the thermal cycle process is started.

The reaction chambers 100*a* of this example are loaded in the holders 11 of the thermal cycler 2 (Step S100). In this example, fourteen of the reaction chambers 100*a* described above are used. The disposition of the holder 11 and the temperature gradient forming unit 30 immediately after the completion of Step S100 is the second disposition, and the reaction mixture 140*a* is positioned in the second portion 112, that is, on the side of the second heating unit 13. After Step S100, when the holders 11 are covered with the lid 50 and the thermal cycler 2 is activated, the fluorescence measurement is performed by the fluorescent detector 40 (Step S200). In the thermal cycler 2, the measurement window 18 and the fluorescent detector 40 oppose each other in the second disposition. Therefore, when the fluorescent detector 40 is activated in the second disposition, the fluorescence measurement is performed via the measurement window 18. In this example, measurement is performed on the plurality of reaction chambers 100*a* in sequence by moving the fluorescent detector 40 along the slide 22. Step S200 is completed upon completion of the measurement of all the reaction chambers 100*a* in Step S200. In this example, Step S200 is terminated upon completion of the fluorescent measurement for all the measurement windows 18.

After completion of Step S200, the holder 11 and the temperature gradient forming unit 30 are rotated from the second disposition to the first disposition (Step S202) by the driving unit 20. Accordingly, the reaction mixture 140*a* is moved to the first portion 111.

After Step S202, the temperature gradient with respect to the channel 110 of the reaction chamber 100*a* is formed by the temperature gradient forming unit 30 (Step S102). In this example, a temperature gradient having a first temperature of 95° C. and a second temperature of 66° C. is formed. Accordingly, a temperature gradient in which the temperature was decreased from 95° C. to 66° C. from the first portion 111 to the second portion 112 of the reaction chamber 100*a* is formed. At a moment when Step S102 is started, the reaction mixture 140*a* is in the first portion 111 and hence is heated to 95° C.

Whether or not a third period has elapsed in the first disposition is determined after Step S102 (Step S204). With the size of the reaction chambers 100*a* in this example, since the period from the start of heating until the formation of the temperature gradient is negligible, the measurement of the elapsed time may be started at the same time with the start of heating. The third period in this example is 10 seconds, and hot start of PCR is performed in the reaction chambers 100*a* during the third period. In other words, the third period is a period required for the hot start. The hot start is a process to activate DNA polymerase contained in the reaction mixture 140*a* by heat and establish a state in which amplification of DNA is enabled. In Step S204, if it is determined that the third period is not elapsed (No in Step S204), the first disposition is maintained (Step S206). After Step S206, Step 204 and Step 206 are repeated until the third period is determined to have elapsed in the Step S204.

If it is determined that the third period has elapsed in Step S204, (YES in Step S204), whether or not the first period has elapsed in the first disposition is determined (Step S104). The first period in this example is one second. In other words, the process of denaturing the double-strand DNA at the temperature of 95° C. is performed for one second. In both of Step S204 and Step S104, the reaction mixture 104*a* is placed at the first temperature, when Step S104 is performed subsequently to Step S204, the activation of polymerase and the denaturing of the DNA are made progress in parallel. When it is determined that the first period is not elapsed in Step S104 (NO in Step S104), the first disposition is maintained (Step S106). After Step S106, Step 104 and Step 106 are repeated until the first period is determined to have elapsed in the Step S104.

In Step S104, if it is determined that the first period has elapsed (Yes in Step S104), the holder 11 and the temperature gradient forming unit 30 are rotated from the first disposition to the second disposition by the driving unit 20 (Step S108). Accordingly, the reaction mixture 140*a* is moved from the portion at 95° C. to the portion at 66° C. of the channel 110 by an action of the gravitational force. In this example, a period required for the rotation in Step S108 is three seconds and, during this period, the reaction mixture 140*a* is moved to the second portion 112. The driving unit 20 stops the rotation when the second disposition is reached under the control of the controller.

Whether or not the second period has elapsed in the second disposition is determined after Step S108 (Step S110). The second period in this example is 15 seconds. In other words, the annealing and the extension reaction at 66° C. are performed for 15 seconds. When it is determined that the second period is not elapsed in Step S110 (NO in Step S110), the second disposition is maintained (Step S112). After Step S112, Step 110 and Step 112 are repeated until the second period is determined to have elapsed in Step S110.

If it is determined that the second period has elapsed in Step S110, (YES in Step S110), whether or not the number of times of the thermal cycle has reached a predetermined number of cycle is determined (Step S114). The predetermined number of cycles in this example is 50 cycles. In other words, whether or not the number of times when the determination of "YES" is made in Step S104 and Step S110 has reached 50 times is determined.

In Step S114, if it is determined that the number of times of the thermal cycle is not reached the predetermined number of cycles (No in Step S114), the holder 11 and the temperature gradient forming unit 30 are rotated from the second disposition to the first disposition by the driving unit (Step S116). Accordingly, the reaction mixture 140*a* is moved from the portion at 66° C. to the portion at 95° C. of the channel 110 by the action of the gravitational force. The driving unit 20 stops the rotation when the first disposition is reached under the control of the controller. After Step S116, Step S104 is performed again. In other words, the second thermal cycle is started.

In Step S114, if it is determined that the number of times of the thermal cycle has reached the predetermined number of cycles (YES in Step S114), the fluorescence measurement is performed by the fluorescent detector 40 (Step S208). Detailed process in Step S208 is the same as in Step S200. After the Step S208, heating by the temperature gradient forming unit 30 is stopped and the thermal cycle process is completed.

FIG. 13A is a table showing results of the fluorescence measurement performed in the procedure of the first example. The fluorescent brightness (intensity) before performing the thermal cycle process is shown as "before reaction", and the fluorescence brightness after having performed the thermal cycle by the predetermined number of times is shown as "after reaction". The ratios of brightness change (%) in the table are values calculated by an expression (1) shown below.

$$\text{(Ratio of Brightness Change)}=100\times\{\text{(after reaction)}-\text{(before reaction)}\}/\text{(before reaction)} \quad (1)$$

The probe used in this example is TaqMan probe. This probe has a nature such that the fluorescence brightness to be detected is increased as the nucleic acid is amplified. As shown in FIG. 13A, the fluorescence brightness of the reaction mixture 140*a* was increased after the execution of the thermal cycle process in comparison with before the execution of the thermal cycle process. The calculated ratios of the brightness change were values indicating that the nucleic acid was sufficiently amplified, and the fact that the nucleic acid was amplified by the thermal cycler 2 in this example was confirmed.

In this example, first of all, the reaction mixture 140*a* can be held at 66° C. for 15 seconds by holding at 95° C. for one second, and then rotating the main unit 10*a* by half a turn by the driving unit 20. Then, the reaction mixture 140*a* can be held at 95° C. again by rotating the main unit 10*a* half a turn by the driving unit 20 again. In other words, by switching the disposition of the holder 11 and the temperature gradient forming unit 30 by the driving unit 20, the reaction mixture 140*a* can be held at the first disposition and the second disposition for a desired period. Therefore, even when the first period and the second period are different in the thermal cycle process, the heating period can be controlled easily, and hence the desired thermal cycle can be applied on the reaction mixture 140*a*.

In this example, since the heating period at the first temperature is one second, the heating period at the second temperature is 15 seconds, and the period required for the reaction mixture 140*a* to move between the first portion 111 and the second portion 112 is three seconds (six seconds for both ways), the required time for one cycle is 22 seconds. Therefore, when the number of cycles is 50 cycles, the thermal cycle can be completed in approximately 19 minutes including the hot start.

6-2. Second Example; 1-step RT-PCR

Figure 11:
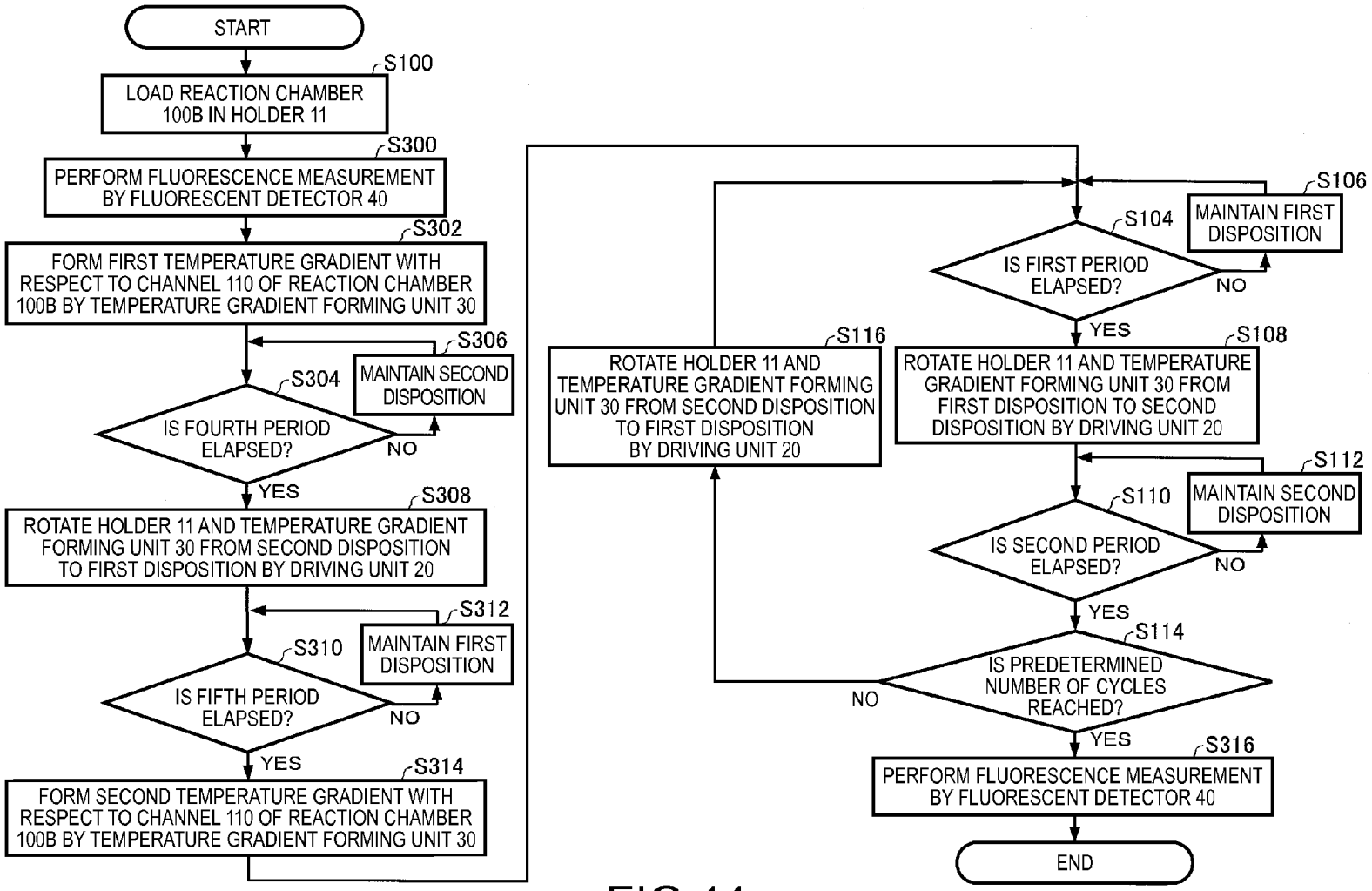
FIG. 11 is a flowchart showing a thermal cycle procedure in a second example.

In this example, the 1-step RT-PCR involving fluorescence measurement using the thermal cycler 2 according to the second embodiment will be described. However, the thermal cycler 1 according to the first embodiment maybe used. FIG. 11 is a flowchart showing a thermal cycle procedure in a second example. In comparison with FIG. 6, the flowchart in FIG. 11 is different in that Step S300, Step S302, Step S304, Step S306, Step S308, Step S310, Step S312, Step S314, and Step S316 are included. The fluorescent detector 40 in this example is 2104 EnVision Multi Label counter (manufactured by PerkinElmer). In the following description, points different from the first example will mainly be described.

The RT-PCR (reverse transcription-polymerase chain reaction) is a method of performing detection and/or quantitative analysis of RNA. The reverse transcription is performed from RNA as a template to DNA at 45° C. using a reverse transcriptase and cDNA synthesized by the reverse transcription is amplified by PCR. In the general RT-PCR, the process of the reverse transcription reaction and the process of the PCR are independent and exchange of the chamber or addition of reagent are performed between the process of the reverse transcription and the process of the PCR. In contrast, in the 1-step RT-PCR, the reverse transcription and reaction of PCR are performed continuously by using a specific reagent. This example, employing the 1-step RT-PCR, is different from the process of the shuttle PCR in the first example in that the process of performing the reverse transcription (from Step S304 to Step S310) and the process for translating to the shuttle PCR (Step S314) are performed.

A reaction chamber 100*b* in this example is the same as the first example except that a component included in a reaction mixture 140*b* is different. FIG. 12 is a table showing compositions of the reaction mixture 140*b* in the second example. In this example, the reaction mixture 140*b* used here is a commercially available kit for the 1-step RT-PCR (One Step SYBR PrimeScript PLUS RT-PCR kit, manufactured by TAKARA BIO Inc., "SYBR" and "PrimeScript" are registered trademark) conditioned to the compositions shown in FIG. 12. "Takara Ex Taq" in FIG. 12 is a registered trademark.

First of all, the reaction chambers 100*b* of this example are loaded in the holders 11 of the thermal cycler 2 (Step S100). In this example, three of the reaction chambers 100*b* described above are used. After Step S100, when the holders 11 are covered with the lid 50, and the thermal cycler 2 is activated, the fluorescence measurement is performed by the fluorescent detector 40 (Step S300).

After Step S300, a first temperature gradient is formed with respect to the channel 110 of the reaction chamber 100*b* by the temperature gradient forming unit 30 (Step S302). In this example, a temperature gradient having a first temperature of 95° C. and a second temperature of 42° C. is formed. Accordingly, a temperature gradient in which the temperature is decreased from 95° C. to 42° C. from the first portion 111 to the second portion 112 of the reaction chamber 100*b* is formed. At a moment when Step S302 is started, the reaction mixture 140*b* is in the second portion 112 and hence is heated to 42° C.

Whether or not a fourth period has elapsed in the second disposition is determined after Step S302 (Step S304). With the size of the reaction chambers 100*b* in this example, a period from the start of heating until the formation of the temperature gradient is negligible, the measurement of the elapsed time may be started at the same time with the start of heating. The fourth period in this example is 300 seconds, and the reverse transcription from RNA to DNA is performed in the reaction chambers 100*b* during the fourth period. In other words, the fourth period is a period required for the reverse transcription from RNA to DNA in the reaction chambers 100*b*. When it is determined that the fourth period is not elapsed in Step S304 (NO in Step S304), the second disposition is maintained (Step S306). After Step S306, Step 304 and Step 306 are repeated until the fourth period is determined to have elapsed in Step S304.

In Step S304, if it is determined that the fourth period has elapsed (Yes in Step S304), the holder 11 and the temperature gradient forming unit 30 are rotated from the second disposition to the first disposition by the driving unit (Step S308). Accordingly, the reaction mixture 140*b* is moved from the portion at 42° C. to the portion at 95° C. of the channel 110 by the action of the gravitational force. In this example, a period required for the rotation in Step S308 is three seconds and, during this period, the reaction mixture 140*b* is moved to the first portion 111. The driving unit 20 stops the rotation when the first disposition is reached under the control of the controller.

Whether or not a fifth period has elapsed in the first disposition is determined after Step S308 (Step S310). The fifth period in this example is 10 seconds. Since the first portion 111 is heated to 95° C., the reaction mixture 140*b* moved to the first portion 111 in Step S308 is heated to 95° C. The reverse transcriptase contained in the reaction mixture 140*b* is deactivated by heating the reaction mixture 140*b* for 10 seconds at 95° C. In other words, the fifth period is a period required for deactivating the reverse transcriptase contained in the reaction mixture 140*b*. When it is determined that the fifth period is not elapsed in Step S310 (NO in Step S310), the first disposition is maintained (Step S312). After Step S312, Step 310 and Step 312 are repeated until the fifth period is determined to have elapsed in Step S310.

When it is determined that the fifth period has elapsed in Step S310 (Yes in Step S310), a second temperature gradient is formed with respect to the channel 110 of the reaction chamber 100*b* by the temperature gradient forming unit 30 (Step S314). In this example, a temperature gradient having a first temperature of 95° C. and a second temperature of 60° C. is formed. Accordingly, a temperature gradient in which the temperature is decreased from 95° C. to 60° C. from the first portion 111 to the second portion 112 of the reaction chamber 100*b* is formed. Accordingly, since the temperature of the first portion 111 becomes 95° C. and the temperature of the second portion 112 becomes 60° C., a temperature gradient suitable for the shuttle PCR is formed in the channel 110 of the reaction chamber 100*b*.

After Step S314, whether or not the first period has elapsed is determined (Step S104). In Step S104, whether or not a period elapsed after the completion of Step S314 has reached the first period may be determined. For example, in Step S104, it is also possible to measure the temperature of the reaction chamber 100*b* using a temperature sensor and determine that Step S314 is completed at a time point when a desired temperature is reached. In this example, since a period required for the change of the temperature is only in a negligible extent, measurement of the elapsed time is started at the same time with the start of the Step S314. Step S104 to be performed subsequent to Step S116 is the same as in the first example.

The processes from Step S106 to Step S116 in this example are the same as those in the first example except that detailed reaction conditions of the thermal cycle process are different. The shuttle PCR is performed by repeating steps from Step S104 to Step S116 under the conditions that the first period is 5 seconds, the second period is 30 seconds, and the predetermined number of cycles is 40 cycles.

In Step S114, if it is determined that the number of times of the thermal cycle has reached the predetermined number of cycles (YES in Step S114), the fluorescence measurement is performed by the fluorescent detector 40 (Step S316). The process in Step S316 is the same as in Step S300. After Step S316, heating by the temperature gradient forming unit 30 is stopped and the thermal cycle process is completed.

FIG. 13B is a table showing results of the fluorescence measurement performed in the procedure of the second example. The fluorescent brightness (intensity) before performing the thermal cycle process is shown as "before reaction", and the fluorescence brightness after having performed the thermal cycle by the predetermined number of times is shown as "after reaction". The ratios of brightness change (%) in the table are values calculated by the expression (1) described above.

The probe used in this example was SYBR Green I. This probe also has a nature such that the fluorescence brightness to be detected is increased as the nucleic acid is amplified. As shown in FIG. 13B, the fluorescence brightness of the reaction mixture 140*b* was increased after the thermal cycle process has performed in comparison with before the thermal cycle process is performed. The calculated ratios of the brightness change were values indicating that the nucleic acid was sufficiently amplified, and the fact that the nucleic acid was amplified by the thermal cycler 2 in this example was confirmed.

In this example, the reaction mixture 140*b* can be heated to a temperature changed by changing the heating temperature at a midpoint. Therefore, in addition to the similar effects as in the first example (shuttle PCR), an effect that processes different in heating temperature can be performed with a single apparatus without increasing the number of heating unit or making the structure of the apparatus complicated is achieved. In addition, a process which requires a change of the heating period at a midpoint can be caused in the reaction mixture 140*b* by changing the period of holding the reaction chamber 100*b* at the first disposition and the second disposition without making the structures of the apparatus or the reaction chamber complicated.

The embodiments and the modification described above are examples only, and the invention is not limited thereto. For example, a plurality of the respective embodiments and the respective modifications may be combined.

Other Embodiments

The present invention is not limited to the embodiments described above, and various modifications may be made. For example, the invention includes variations of the configuration described in the embodiments (for example, the configuration in which the function, the method and the result are the same, or the configuration having the same object or the effect). The invention includes also a configuration in which portions which are not essential in the configuration described in the embodiments are replaced. The invention also includes configurations which achieve the same effects and advantages as the configurations described in the embodiments, and configurations which are able to achieve the same object. The invention also includes a configuration including known techniques added to the configuration described in the embodiments.

What is claimed is:

1. A thermal cycler comprising:

a holder configured to receive a reaction chamber including a channel filled with reaction mixture and a liquid having a different specific gravity from the reaction mixture and being immiscible with the reaction mixture, the channel extending linearly from a first end of the reaction chamber to an opposing second end of the reaction chamber, being configured to allow the reaction mixture to move along an opposed inner wall;

a temperature gradient forming unit configured to form a temperature gradient in a direction in which the reaction mixture moves with respect to the channel when the reaction chamber is loaded in the holder; and a driving unit configured to rotate the holder and the temperature gradient forming unit about an axis of rotation having a component perpendicular to a direction in which gravitational force acts, and a component perpendicular to the direction of movement of the reaction mixture in the channel when the reaction chamber is loaded in the holder, wherein a maximum distance from the axis of rotation to a point in the channel furthest from the axis of rotation is less than a maximum distance connecting two points furthest from each other in the interior of the channel when projected on a plane perpendicular to the axis of rotation.

2. The thermal cycler according to claim 1, wherein the driving unit is configured to rotate the holder and the temperature gradient forming unit between a first disposition and a second disposition that is different from the first disposition, the holder and the temperature gradient forming unit are rotated in a first direction during rotation from the first disposition to the second disposition and are rotated in a second direction during rotation from the second disposition to the first disposition, and the first and second directions are opposite to one another.

3. The thermal cycler according to claim 1, wherein the holder includes a first holder and a second holder configured to respectively receive the reaction chambers; and the direction of movement of the reaction mixture in the reaction chamber to be loaded in the first holder and the direction of movement of the reaction mixture in the reaction chamber to be loaded in the second holder are parallel to each other.

4. The thermal cycler according to claim 3, wherein the first holder and the second holder are located at different positions when projected on the plane perpendicular to the axis of rotation.

5. The thermal cycler according to claim 4, wherein the axis of rotation is located in an area interposed between the first holder and the second holder when projected on the plane perpendicular to the axis of rotation.

* * * * *